US012611582B2

(12) United States Patent
Lagier

(10) Patent No.: US 12,611,582 B2
(45) Date of Patent: Apr. 28, 2026

(54) SWING GUIDE DEVICE

(71) Applicant: Les Lagier, Roseville, CA (US)

(72) Inventor: Les Lagier, Roseville, CA (US)

( * ) Notice: Subject to any disclaimer, the term of this patent is extended or adjusted under 35 U.S.C. 154(b) by 352 days.

(21) Appl. No.: 18/513,589

(22) Filed: Nov. 19, 2023

(65) Prior Publication Data

US 2024/0374976 A1 Nov. 14, 2024

Related U.S. Application Data

(60) Provisional application No. 63/464,997, filed on May 9, 2023.

(51) Int. Cl.
*A63B 69/00* (2006.01)

(52) U.S. Cl.
CPC .. *A63B 69/0002* (2013.01); *A63B 2069/0008* (2013.01); *A63B 2225/09* (2013.01)

(58) Field of Classification Search
CPC ..... A63B 69/0002; A63B 2069/0008; A63B 2225/09; A63B 2210/50; A63B 69/3621
USPC ..... 473/451, 453
See application file for complete search history.

(56) References Cited

U.S. PATENT DOCUMENTS 3,437,339 A * 4/1969 Starck ..... A63B 69/3608 473/211
4,392,650 A * 7/1983 Hilton ..... A63B 69/38 473/464
4,605,226 A * 8/1986 Morrissey ..... A63B 69/0024 D29/109
8,091,150 B2 * 1/2012 Bengochea ..... A42B 3/16 2/15
9,956,467 B2 * 5/2018 Vehslage ..... A63B 69/38
2007/0243956 A1 * 10/2007 Harris ..... A63B 21/0608 473/458
2011/0201455 A1 * 8/2011 Falls ..... A63B 57/00 473/409
2017/0028287 A1 * 2/2017 Faucette ..... A63B 69/3667
2022/0305364 A1 * 9/2022 Draeger ..... A63B 69/3621

* cited by examiner

*Primary Examiner* — Nini F Legesse
(74) *Attorney, Agent, or Firm* — Craig A. Simmermon

(57) ABSTRACT

A swing guide device that is used to help guide and teach proper swinging form for many sports such as baseball and softball. Swing guide is a pole or rigid oblong member that is reversibly rigidly attachable to a baseball helmet or a softball helmet in a very specific orientation relative to the helmet so that the pole or rigid oblong member guides a bat during a bat swing and causes the bat to swing exactly in the "swing plane". The swing plane is coincident with the trajectory of a baseball passing over home plate. Swing guide device functions as a guide to literally keep the bat on track and in the proper swing plane in order to teach proper swinging technique and instill this into the muscle memory of the batter and making it second nature for the batter.

4 Claims, 47 Drawing Sheets

SWING GUIDE DEVICE

CROSS-REFERENCE TO RELATED APPLICATIONS

The instant application claims priority to U.S. Provisional Application Ser. No. 63/464,997 entitled "Swing Guide Device" filed on May 9, 2023.

BACKGROUND OF THE INVENTION

1. Field of the Invention

This invention relates to a swing guide device that is used to help guide and teach proper swinging form for many sports such as baseball, softball, golf, cricket, lacrosse, or any other sport that involves swinging an object. Additionally, swing guide device is used to help guide and teach proper throwing form for many sports such as baseball, softball, golf, cricket, lacrosse, or any other sport that involves throwing an object. Specifically, this invention is a pole or rigid oblong member that is reversibly rigidly attachable to a baseball helmet or a softball helmet wherein the pole or rigid oblong member is attached and held in a very specific orientation relative to the helmet so that the pole or rigid oblong member guides a bat during a bat swing and causes the bat to swing exactly in the "swing plane". The swing plane is the plane which intersects the exact angle of trajectory of a baseball passing over home plate. The swing plane is coincident with the trajectory of the baseball thrown by the pitcher. The pole or rigid oblong member functions as a guide for the bat to literally keep the bat on track and in the proper swing plane in order to teach the batter proper swinging technique and instill this proper technique into the muscle memory of the batter, thereby making it second nature for the batter.

2. Description of Related Art

There are other swing guide devices in the prior art, however, there are none that incorporate a pole or rigid oblong member that is reversibly rigidly attachable to a baseball helmet or softball helmet that guides the bat during a bat swing to cause the bat to swing in an exact plane that coincides with the swing plane or trajectory of a baseball as shown and described below. Additionally, there are no other swing guide devices in the prior art that reversibly rigidly attachable to a baseball helmet or softball helmet as shown and described below.

DEFINITION LIST

Figure 1:
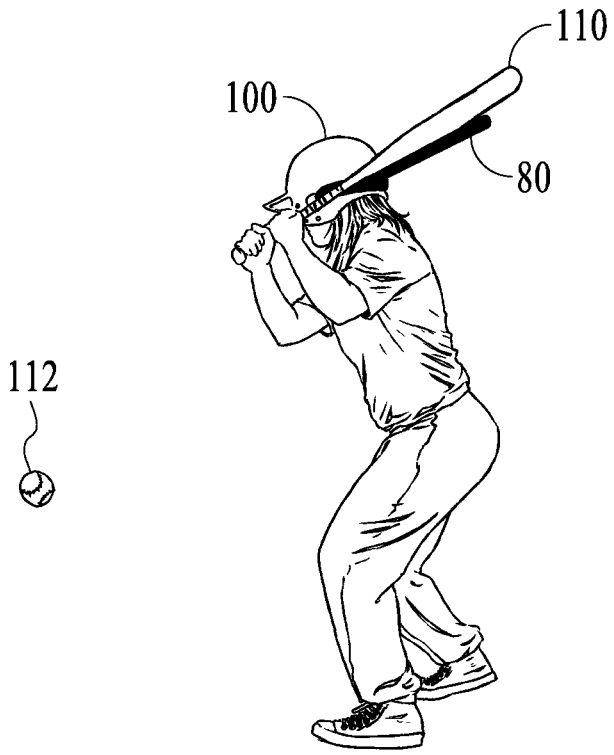
FIG. 1 is a perspective view of a left-handed batter with swing guide device reversibly rigidly attached to a helmet, just prior to starting a swing at a baseball.
Figure 2:
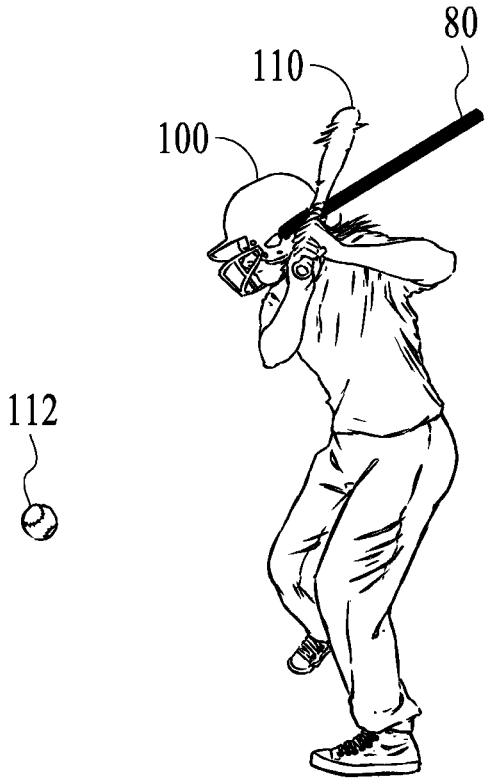
FIG. 2 is a perspective view of a left-handed batter with swing guide device reversibly rigidly attached to a helmet at the start of a swing.
Figure 3:
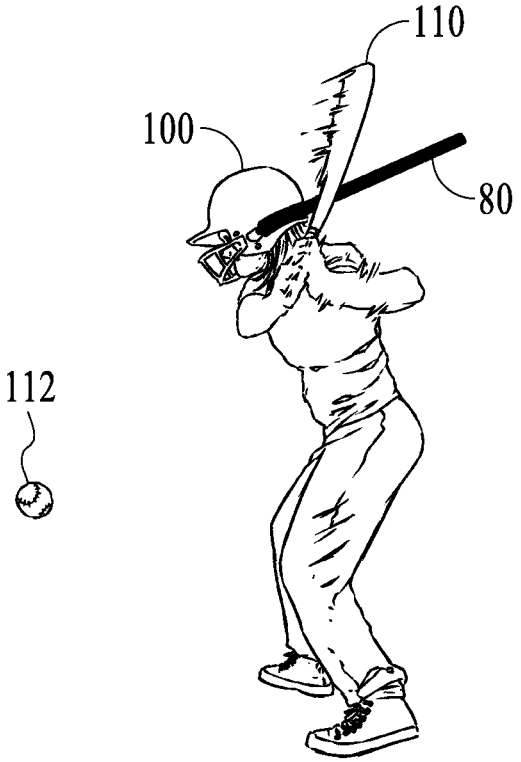
FIG. 3 is a perspective view of a left-handed batter with swing guide device reversibly rigidly attached to a helmet, continuing on with the swing, depicting how the swing guide device guides the bat into the proper swing plane as the batter slides the bat along the length of the swing guide device, keeping the bat in contact with the swing guide device.
Figure 4:
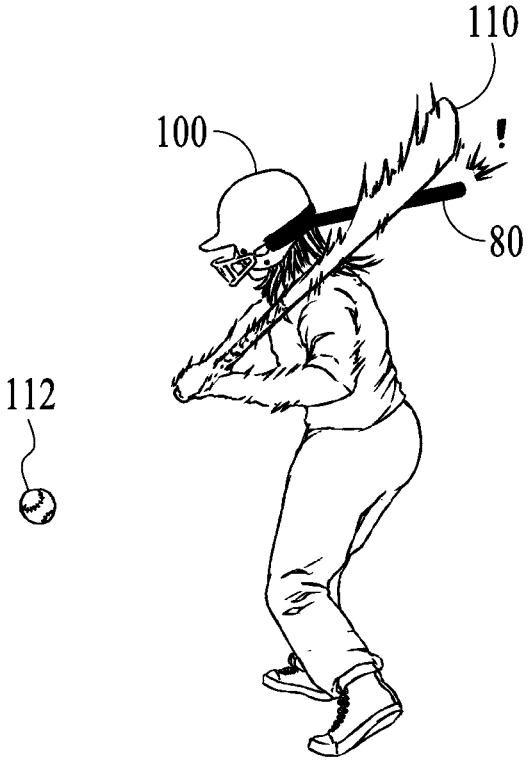
FIG. 4 is a perspective view of a left-handed batter with swing guide device reversibly rigidly attached to a helmet, continuing on with the swing, depicting how the swing guide device further guides the bat into the proper swing plane as the batter continues to slide the bat along the length of the swing guide device, keeping the bat in contact with the swing guide device.
Figure 5:
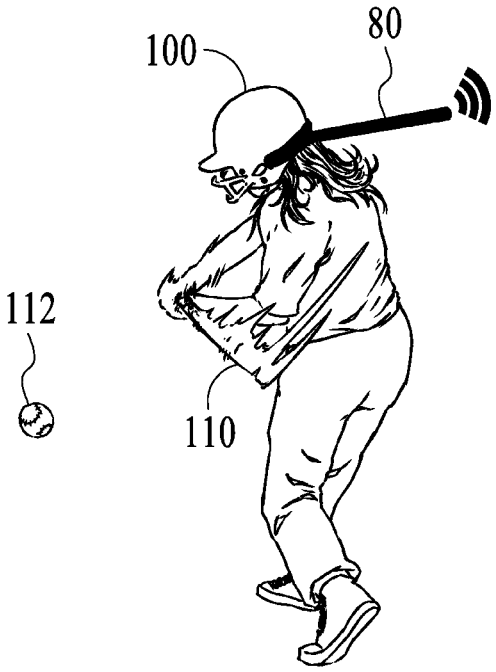
FIG. 5 is a perspective view of a left-handed batter with swing guide device reversibly rigidly attached to a helmet, continuing on with the swing, depicting how the bat stays in the proper swing plane even after leaving contact with the swing guide device.
Figure 6:
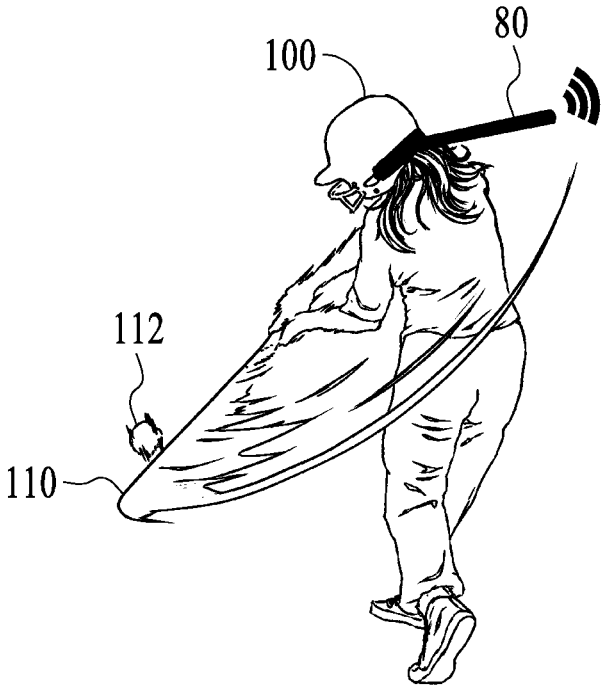
FIG. 6 is a perspective view of a left-handed batter with swing guide device reversibly rigidly attached to a helmet, continuing on with the swing, depicting how the bat stays in the proper swing plane as the bat makes contact with the baseball.
Figure 7:
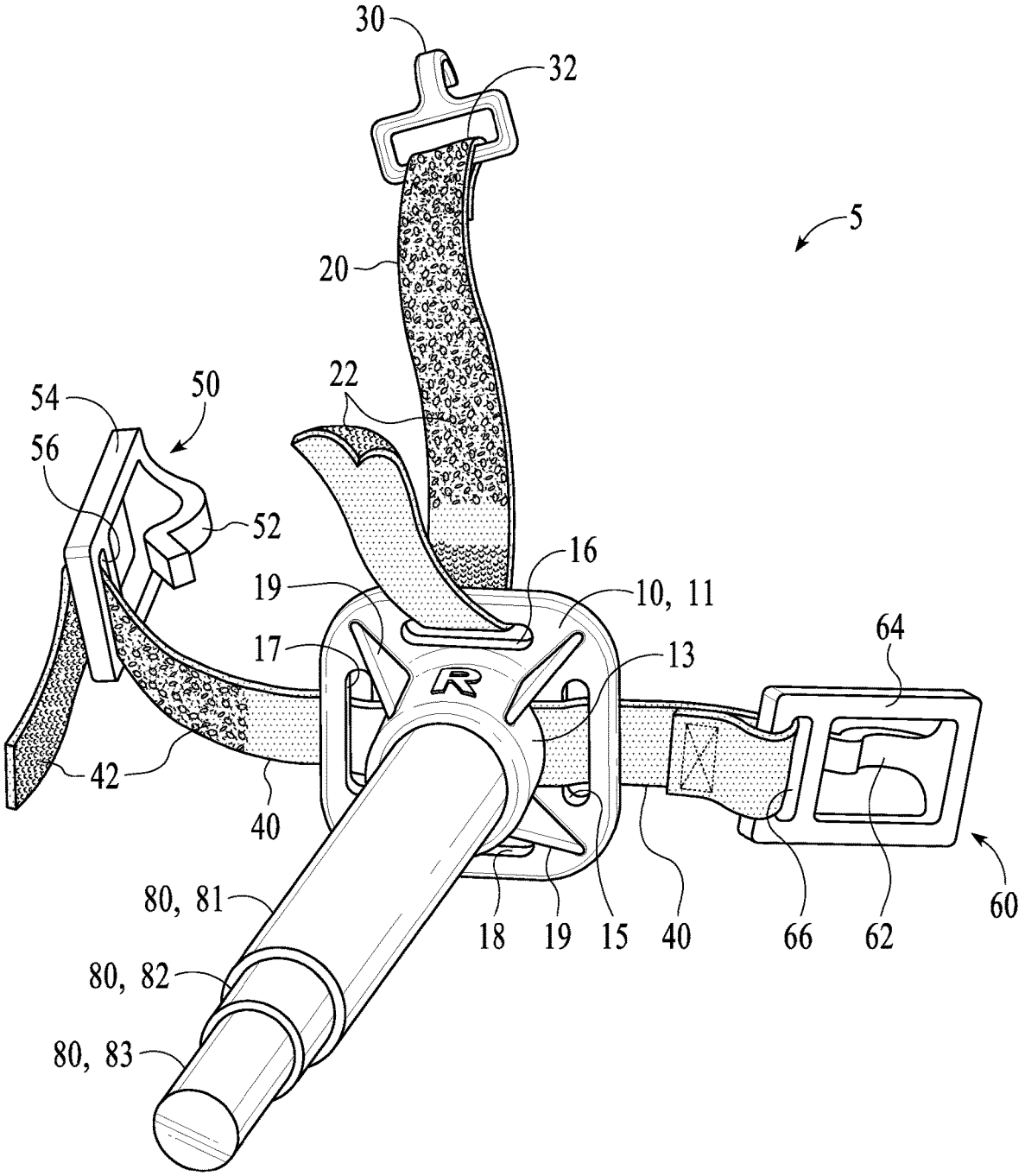
FIG. 7 is a perspective view of a first embodiment of swing guide device in the right-handed batter configuration.
Figure 8:
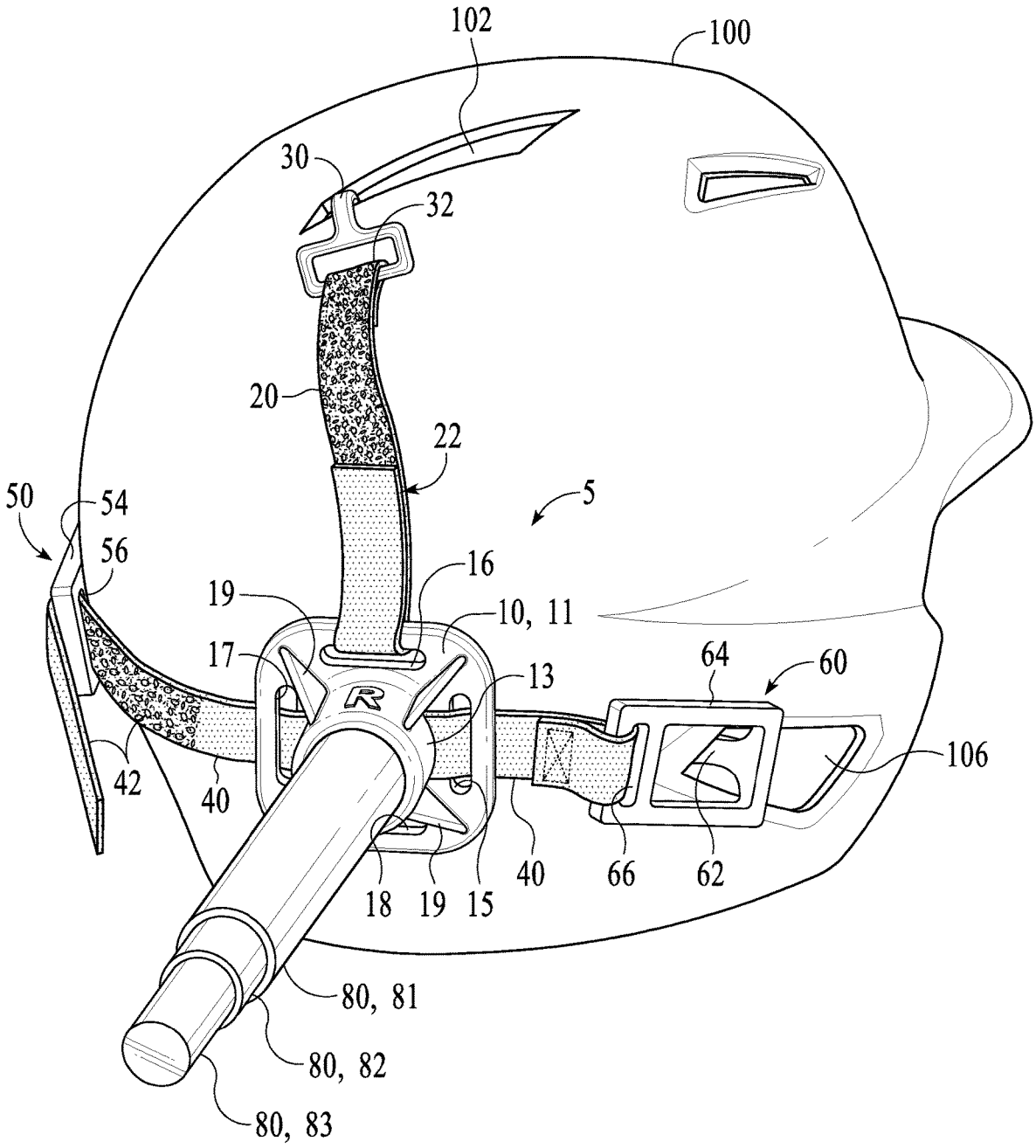
FIG. 8 is a perspective view of a first embodiment of swing guide device in the right-handed batter configuration reversibly rigidly attached to a helmet with pole or rigid oblong member retracted.
Figure 9:
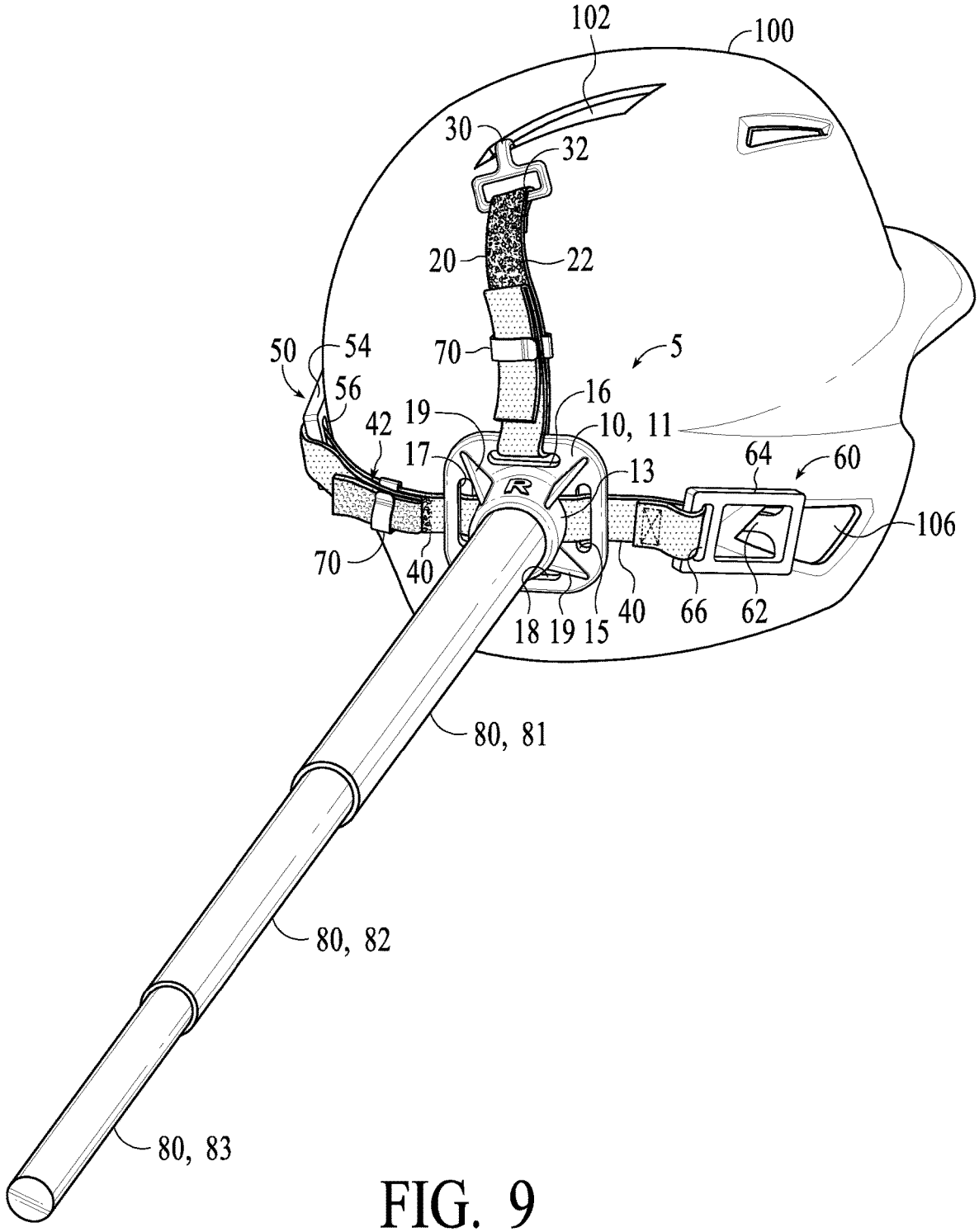
FIG. 9 is a perspective view of a first embodiment of swing guide device in the right-handed batter configuration reversibly rigidly attached to a helmet with pole or rigid oblong member extended.
Figure 10:
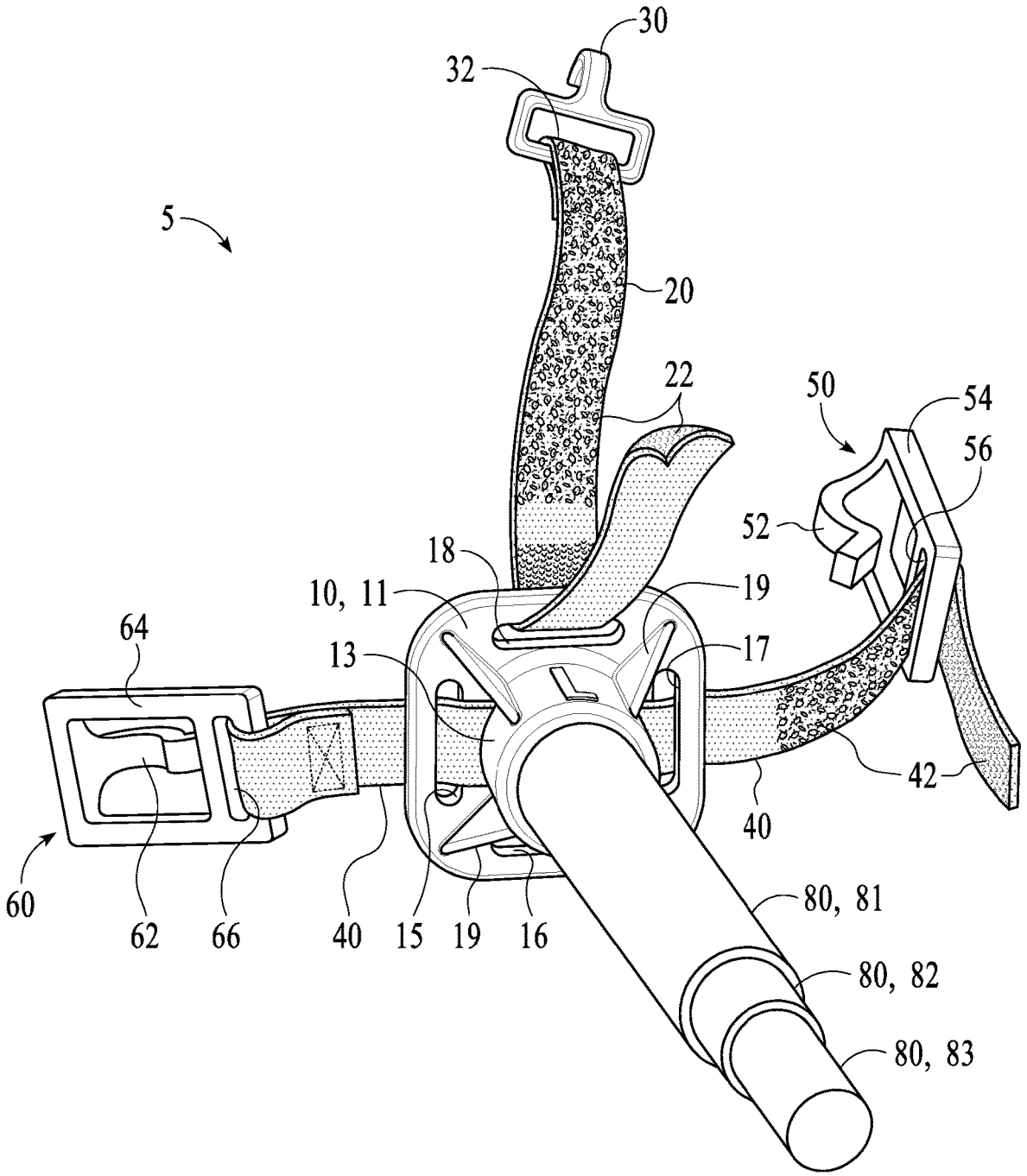
FIG. 10 is a perspective view of a first embodiment of swing guide device in the left-handed batter configuration.
Figure 11:
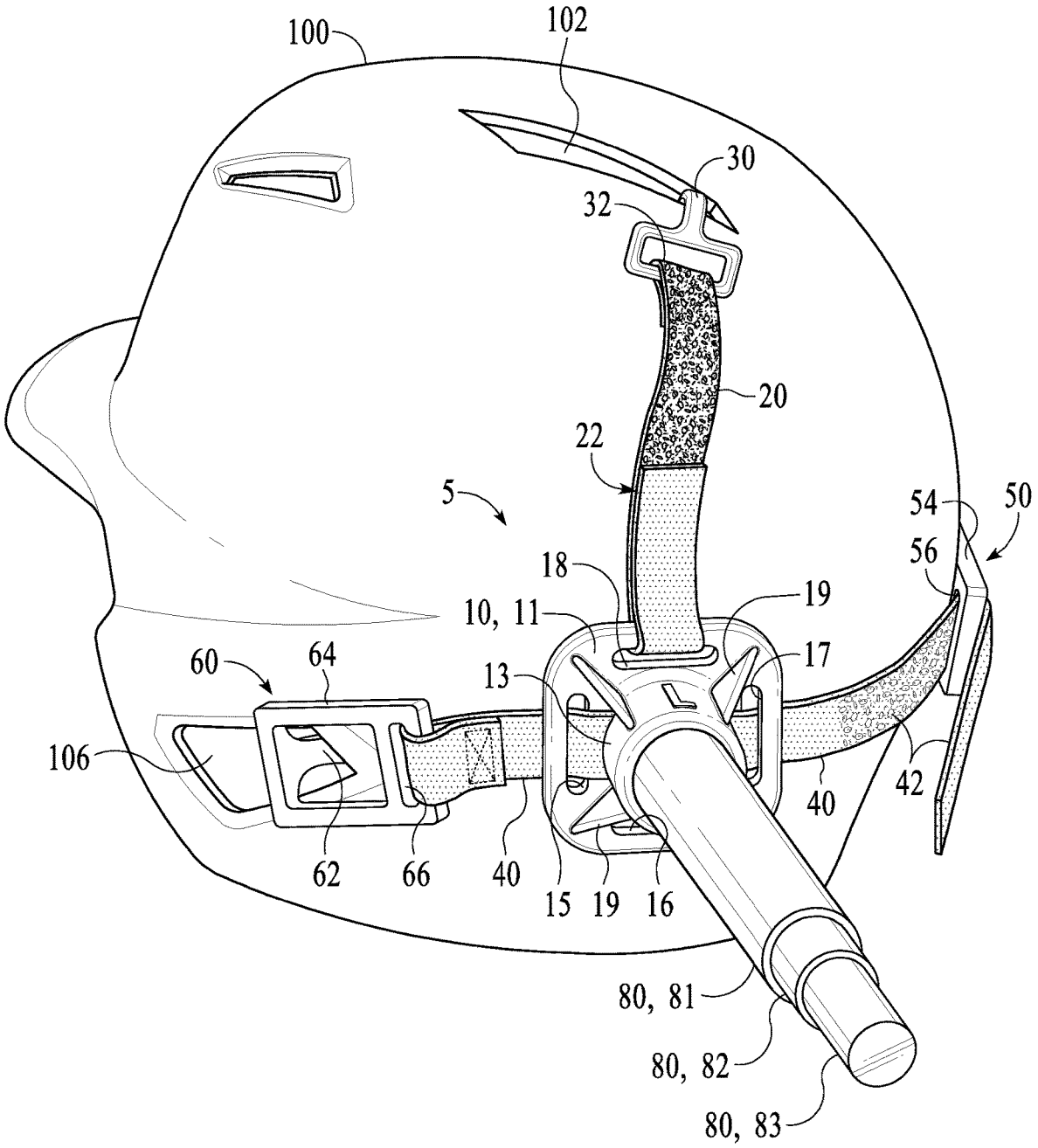
FIG. 11 is a perspective view of a first embodiment of swing guide device in the left-handed batter configuration reversibly rigidly attached to a helmet with pole or rigid oblong member retracted.
Figure 12:
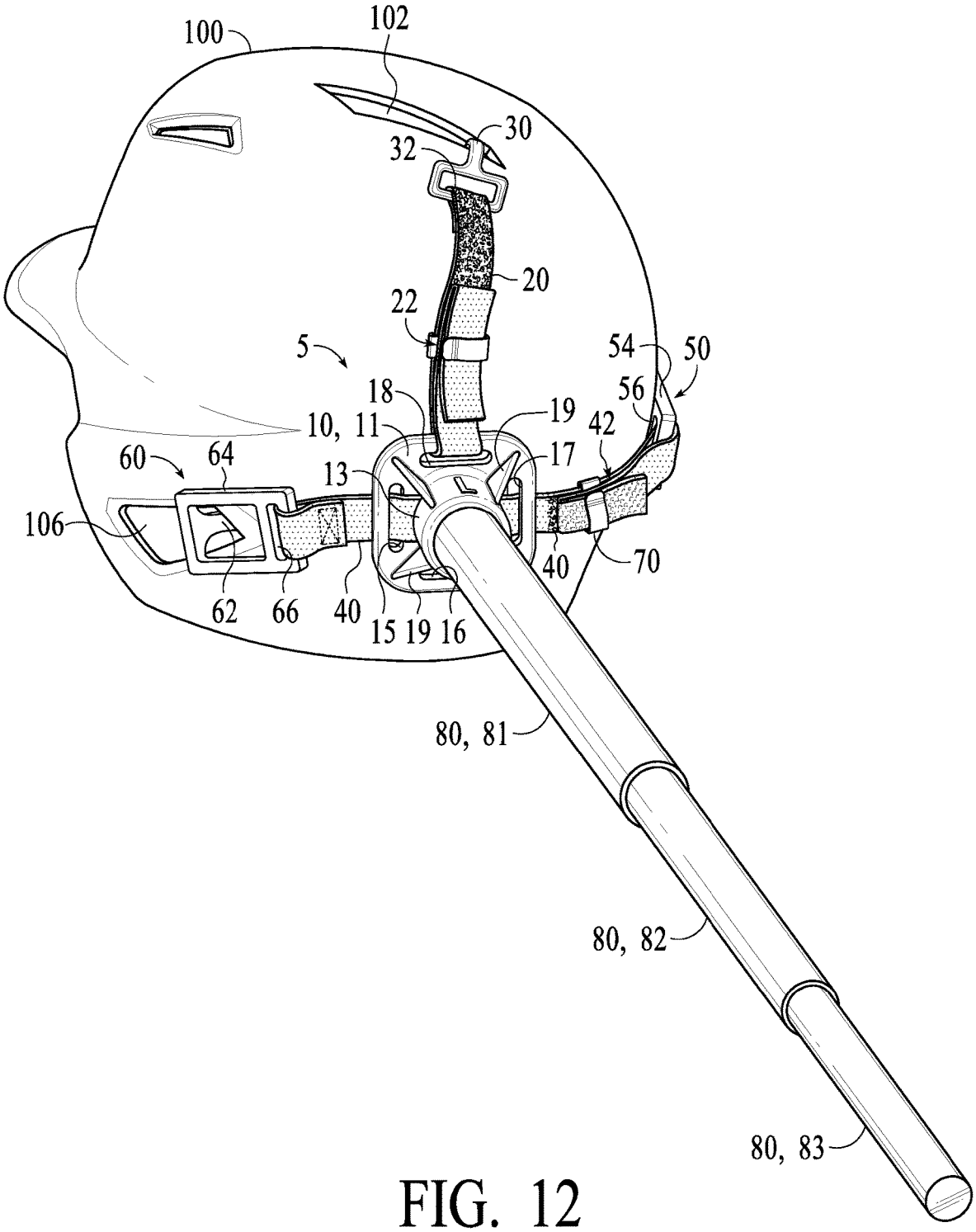
FIG. 12 is a perspective view of a first embodiment of swing guide device in the left-handed batter configuration reversibly rigidly attached to a helmet with pole or rigid oblong member extended.
Figure 13:
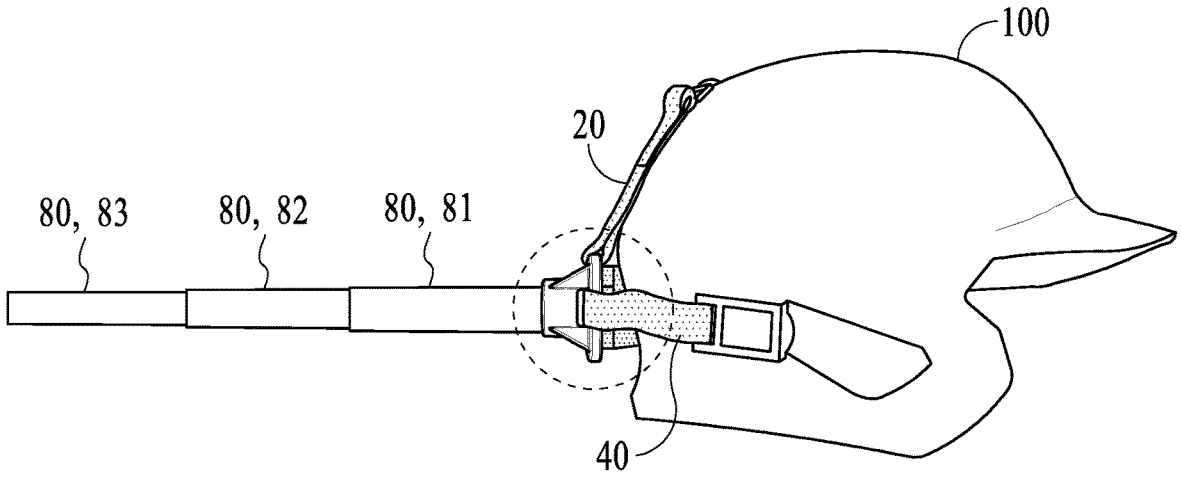
FIG. 13 is side elevation view of a first embodiment of swing guide device reversibly rigidly attached to a helmet depicting usage of the adjustment wedge.
Figure 14:
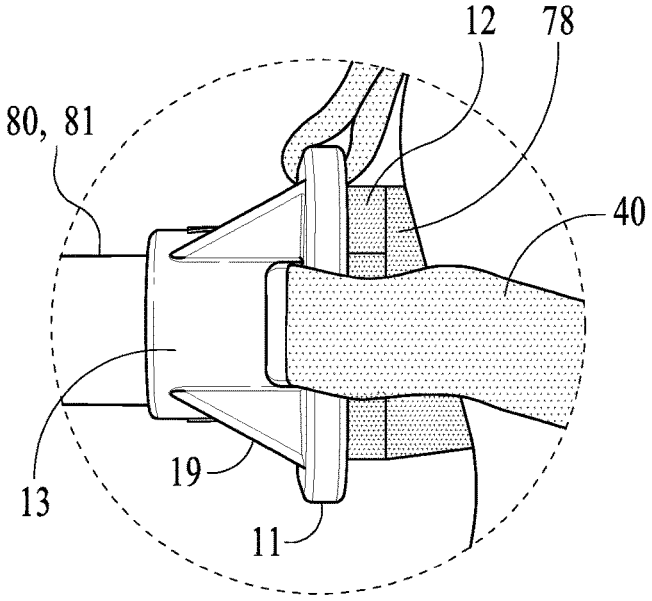
FIG. 14 is an enlarged view of FIG. 15 depicting usage of the adjustment wedge.
Figure 15:
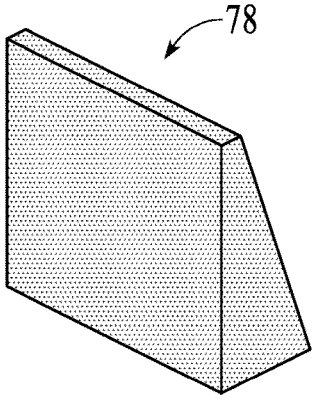
FIG. 15 is a perspective view of adjustment wedge.
Figure 16:
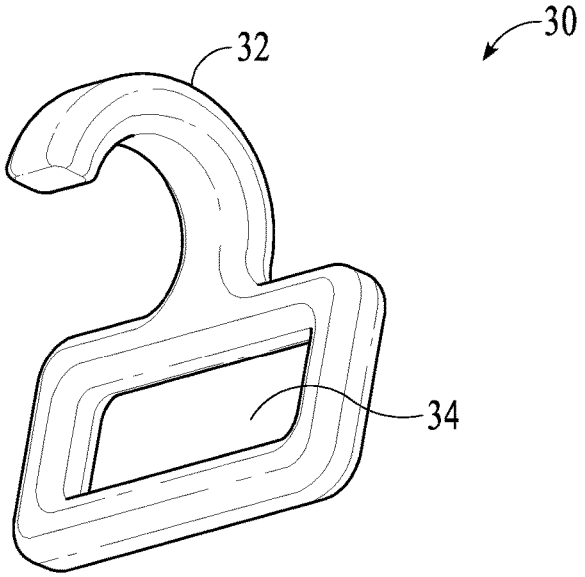
FIG. 16 is a perspective view of upper connector.
Figure 17:
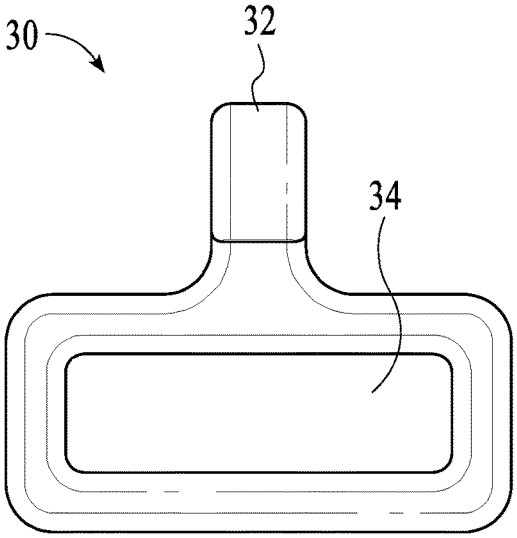
FIG. 17 is top plan view of upper connector.
Figure 18:
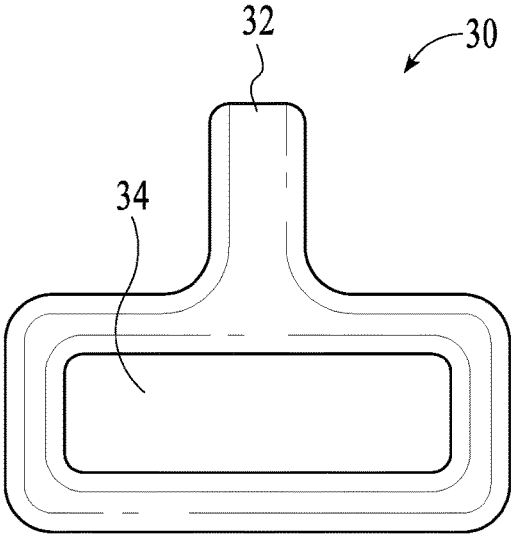
FIG. 18 is a bottom plan view of upper connector.
Figure 19:
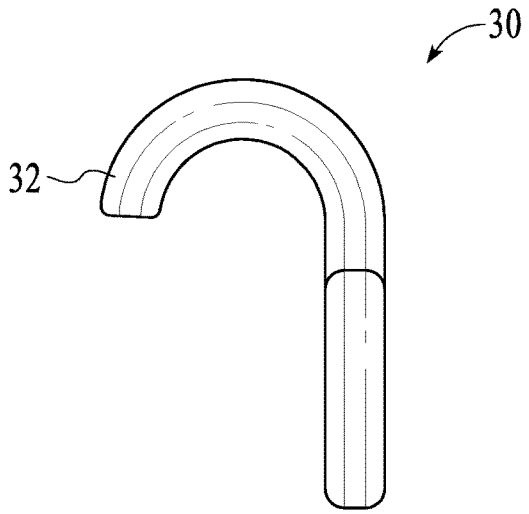
FIG. 19 is a right side elevation view of upper connector, the left side elevation view being a mirror image thereof.
Figure 20:
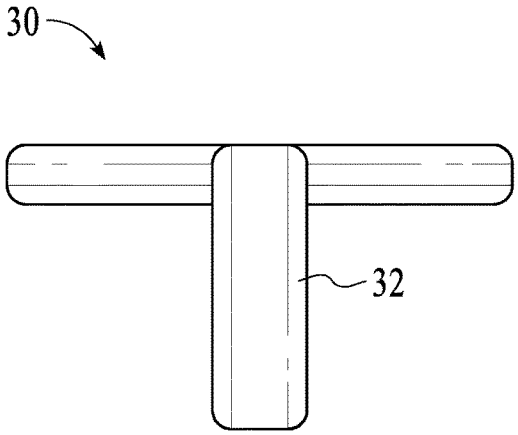
FIG. 20 is a front elevation view of upper connector.
Figure 21:
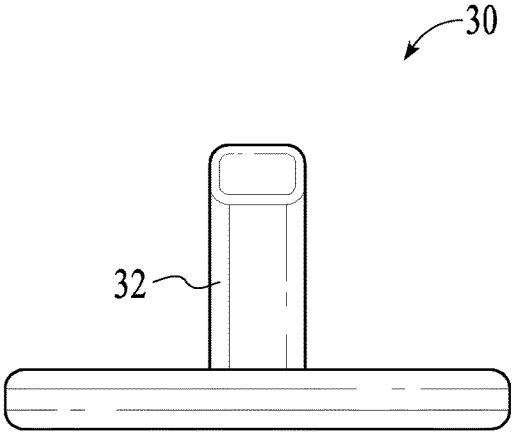
FIG. 21 is a rear elevation view of upper connector.
Figure 22:
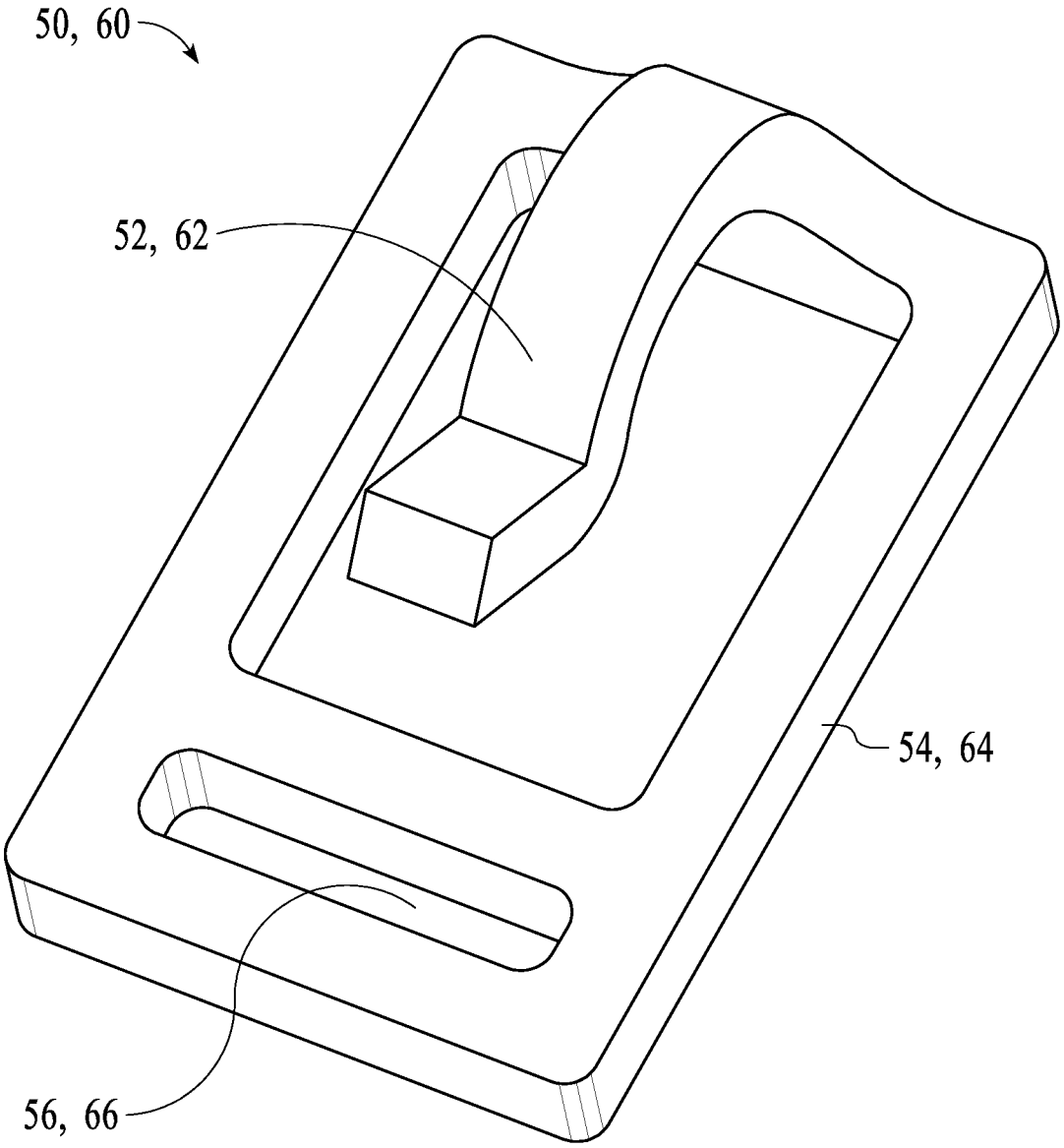
FIG. 22 is a perspective view of first and second connector.
Figure 23:
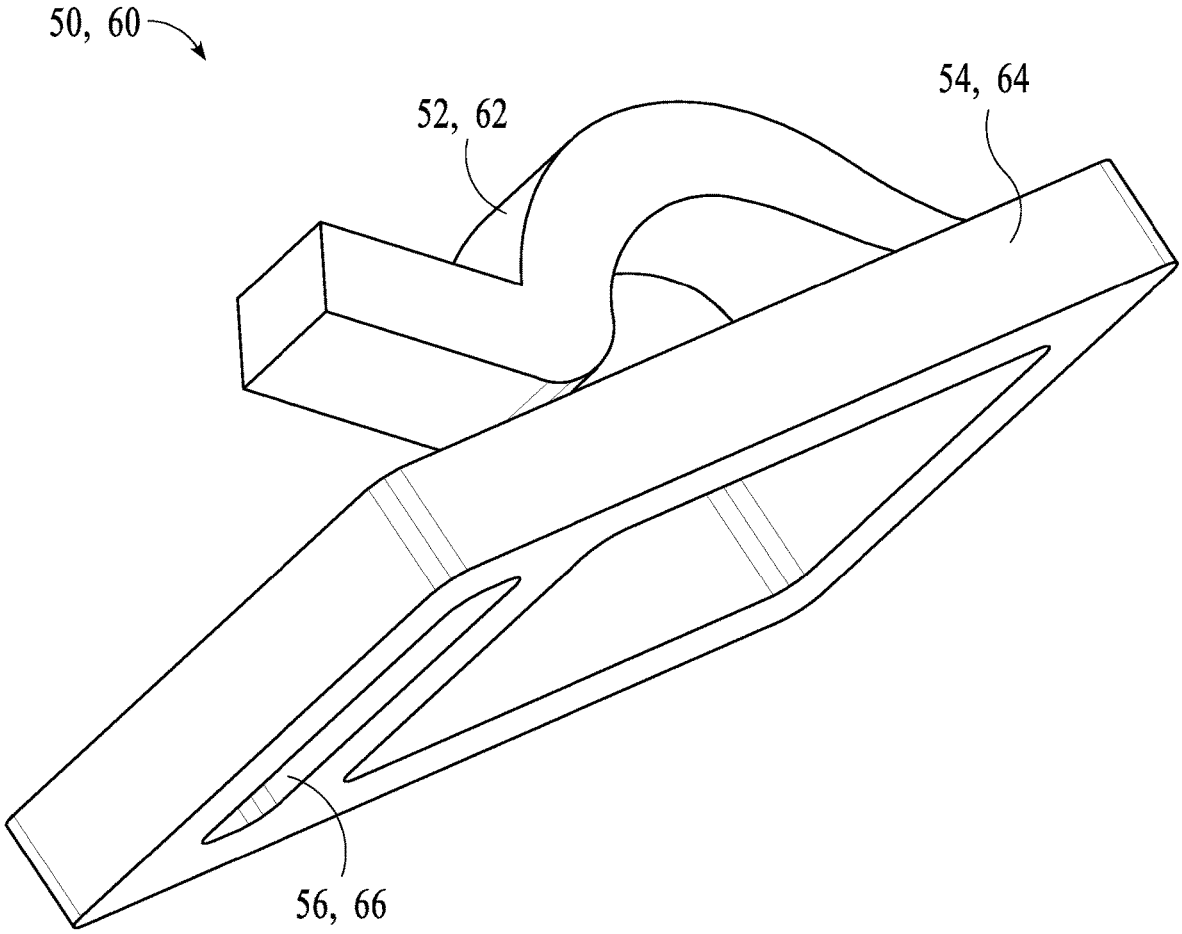
FIG. 23 is another perspective view of first and second connector.
Figure 24:
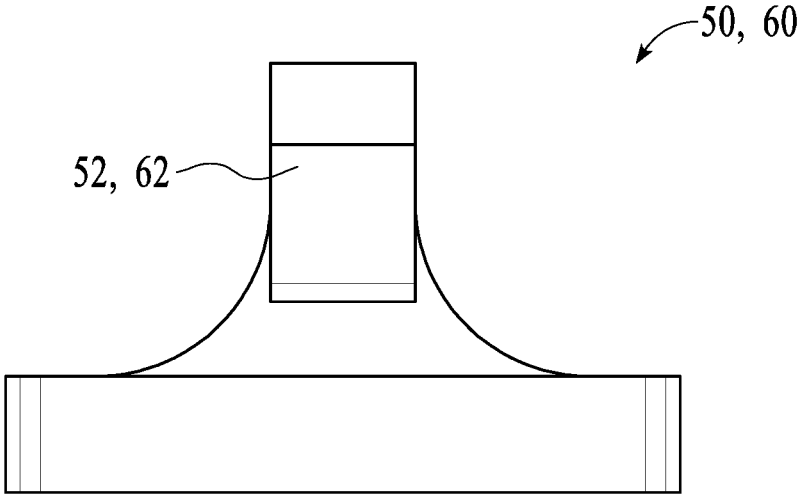
FIG. 24 is a rear elevation view of first and second connector.
Figure 25:
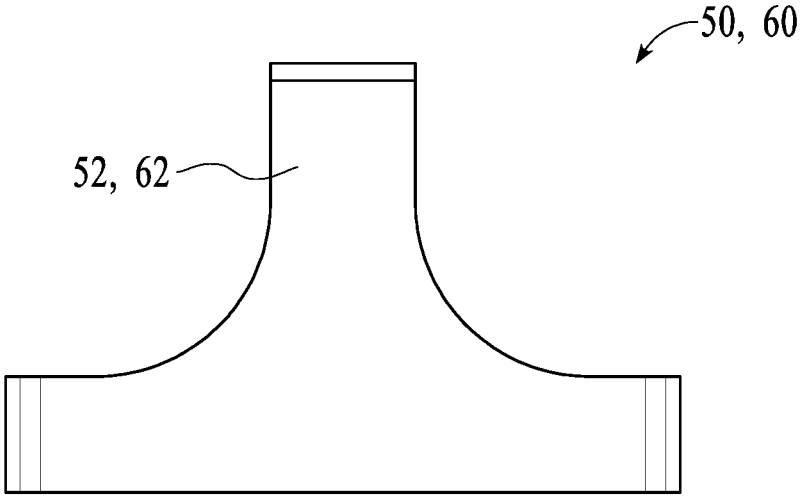
FIG. 25 is a front elevation view of first and second connector.
Figure 26:
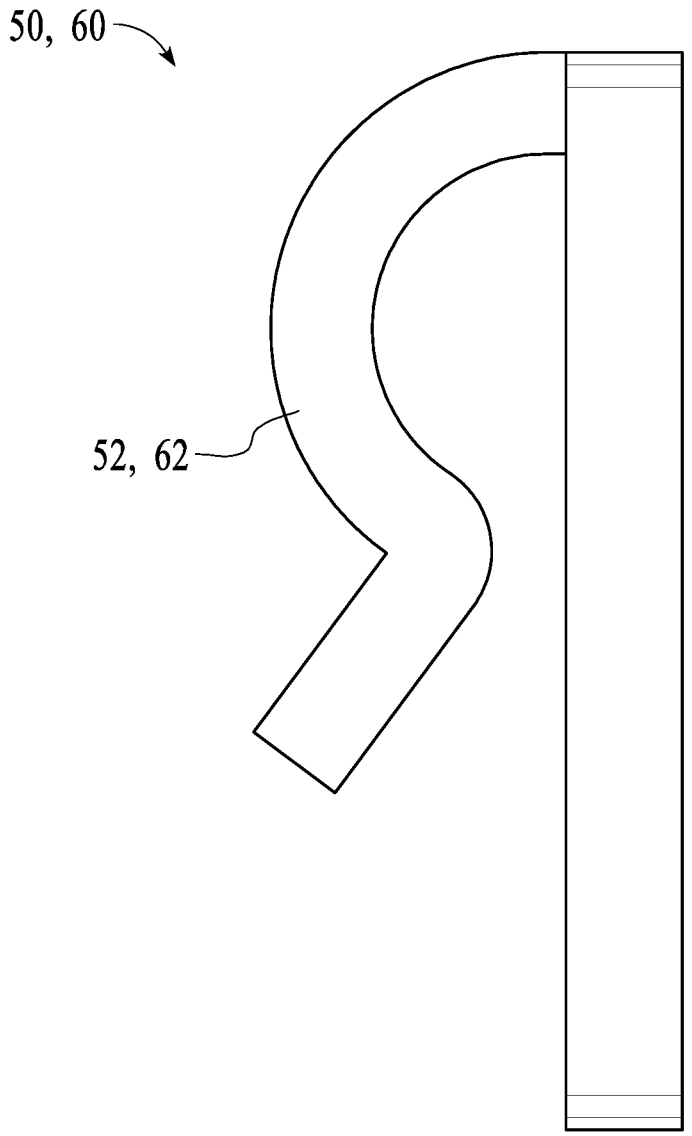
FIG. 26 is a right side elevation view of first and second connector, the left side elevation view being a mirror image thereof.
Figure 27:
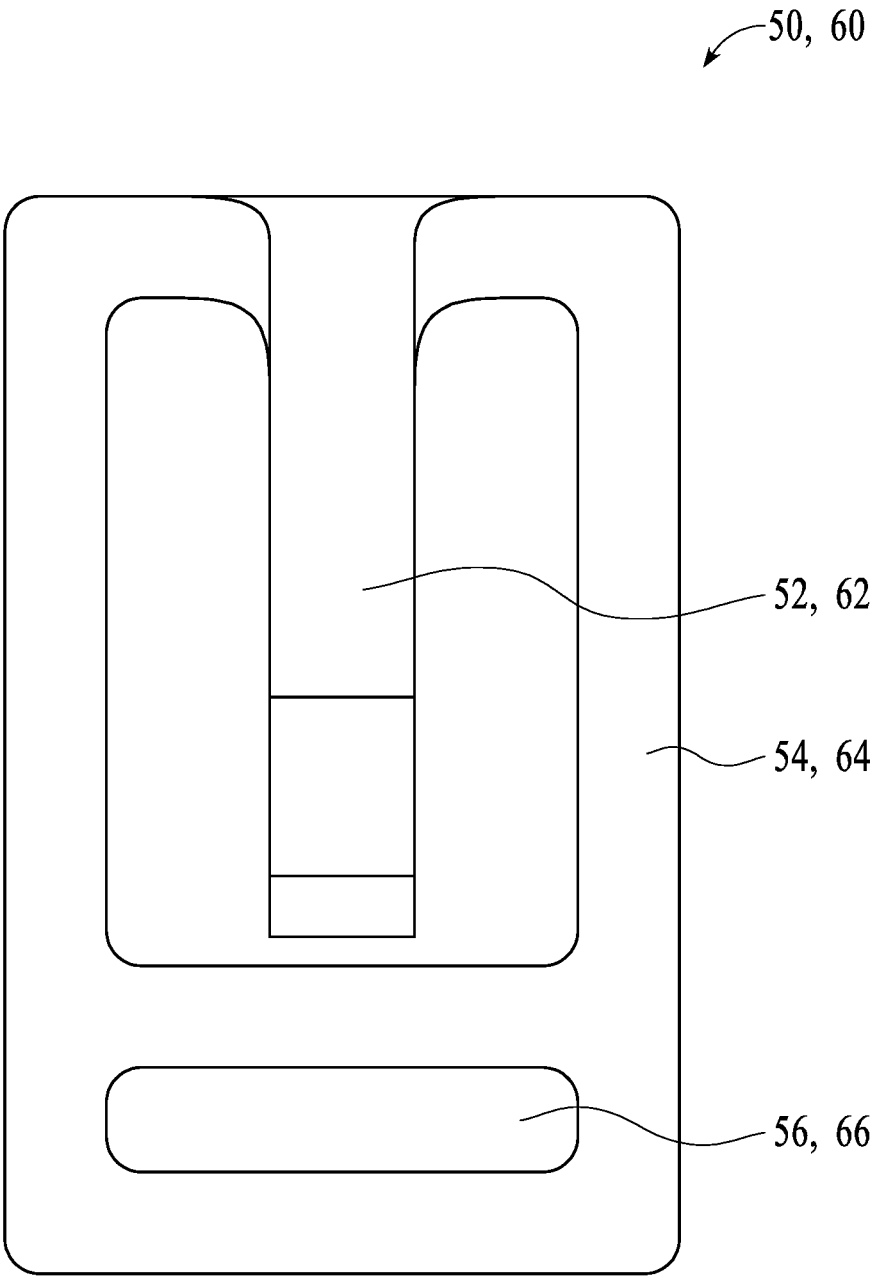
FIG. 27 is top plan view of upper connector.
Figure 28:
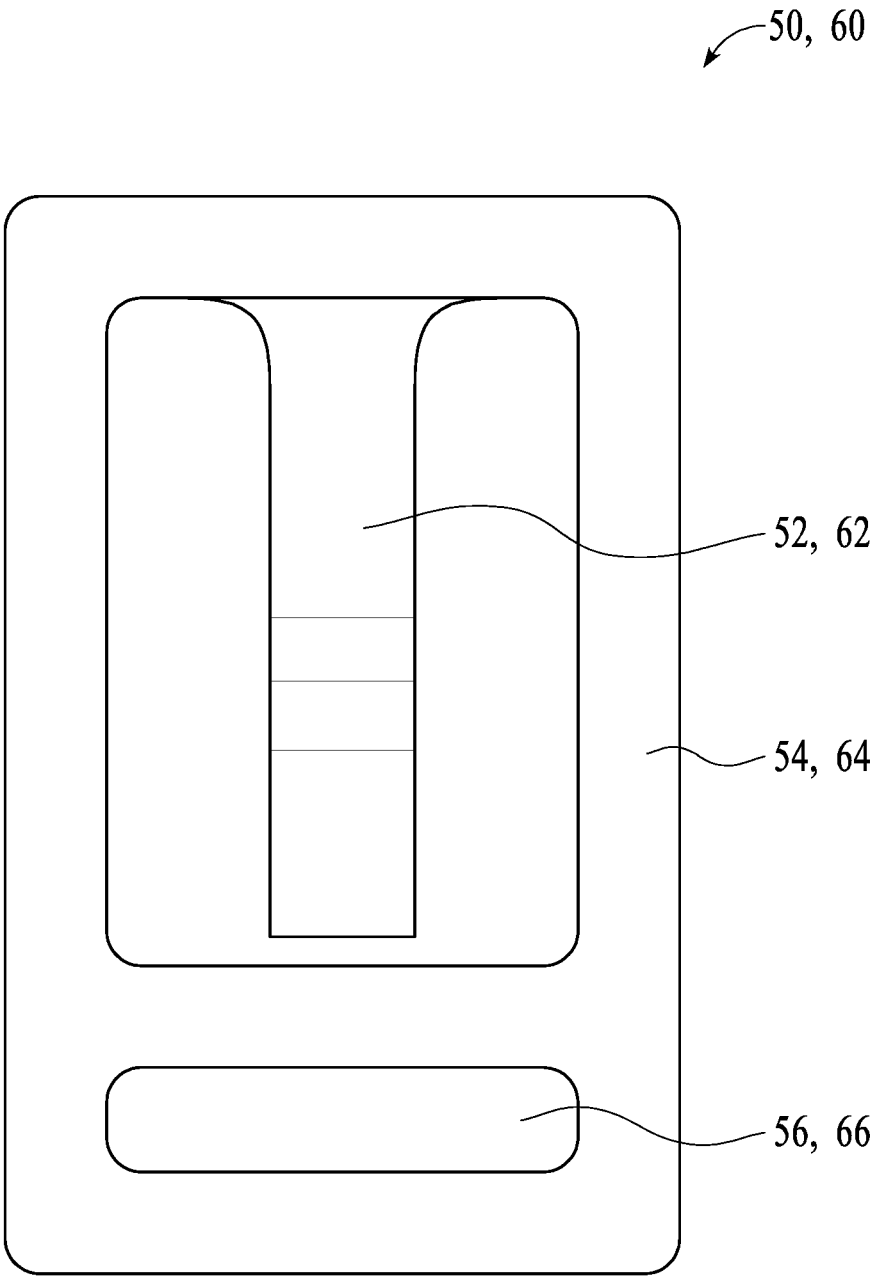
FIG. 28 is a bottom plan view of upper connector.
Figure 29:
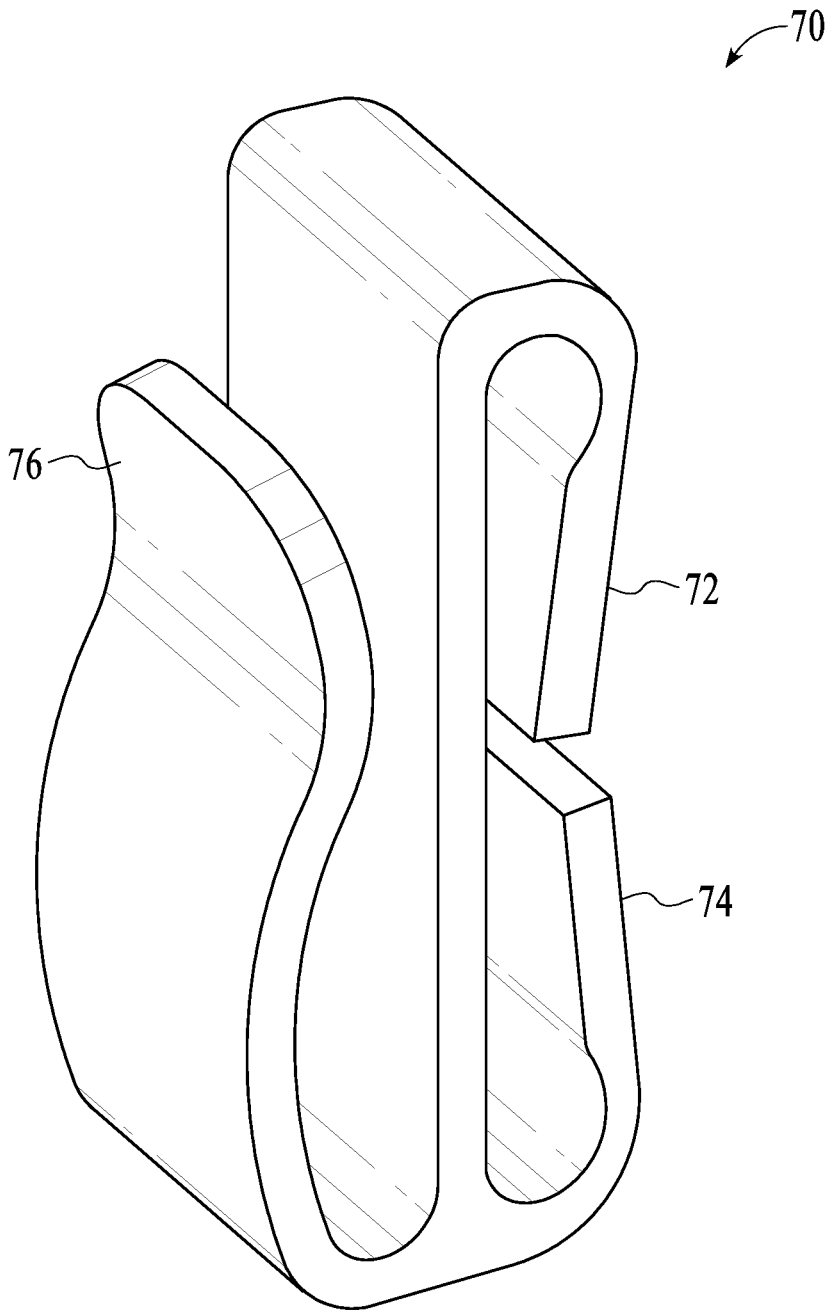
FIG. 29 is a perspective view of strap clasp.
Figure 30:
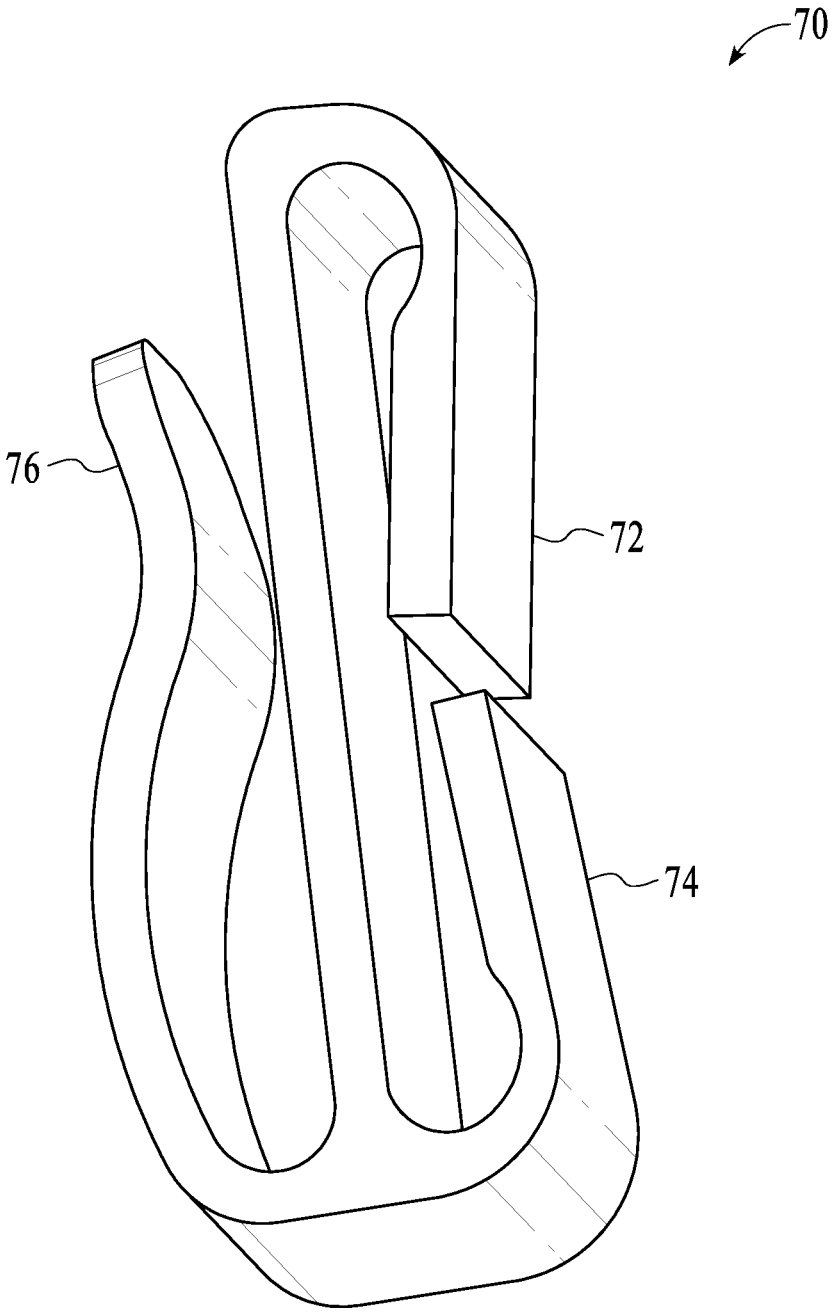
FIG. 30 is another perspective view of strap clasp.
Figure 31:
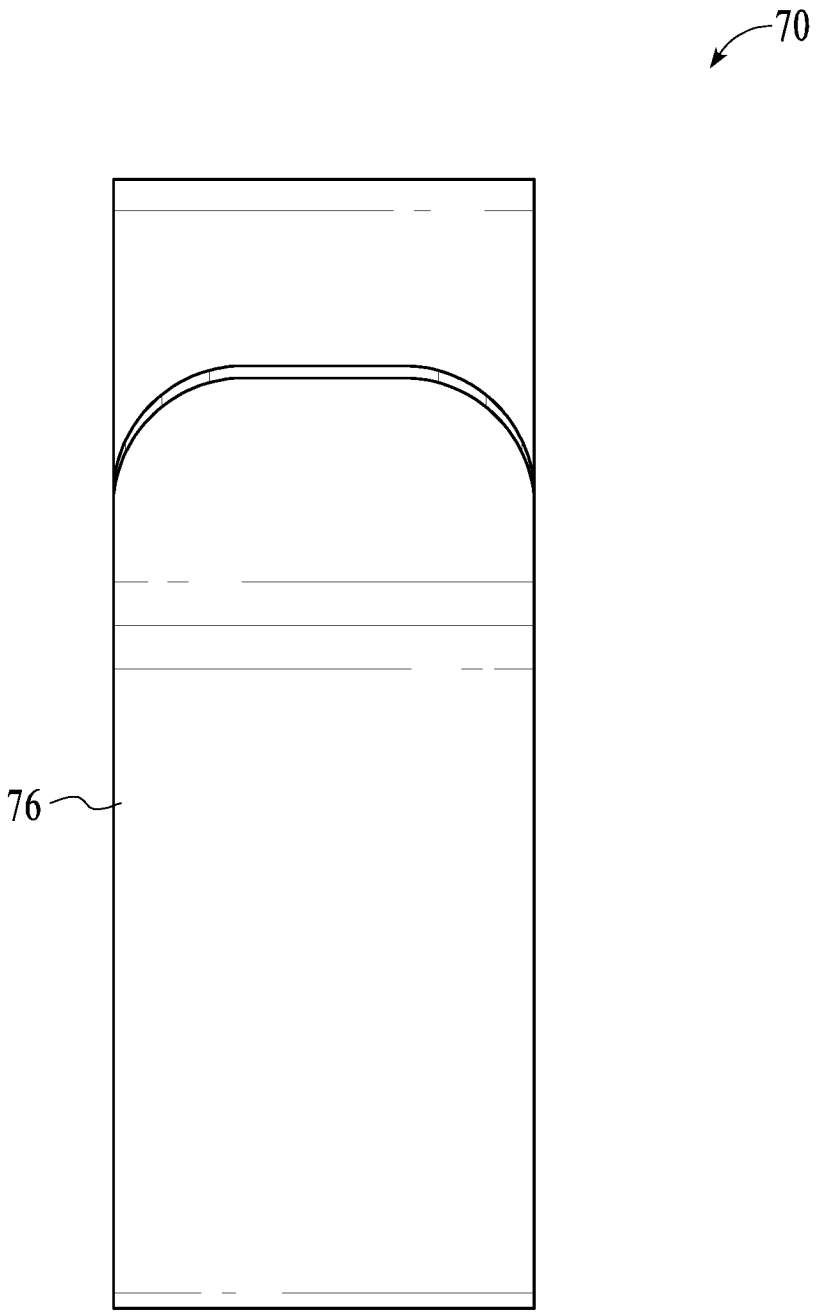
FIG. 31 is top plan view of strap clasp.
Figure 32:
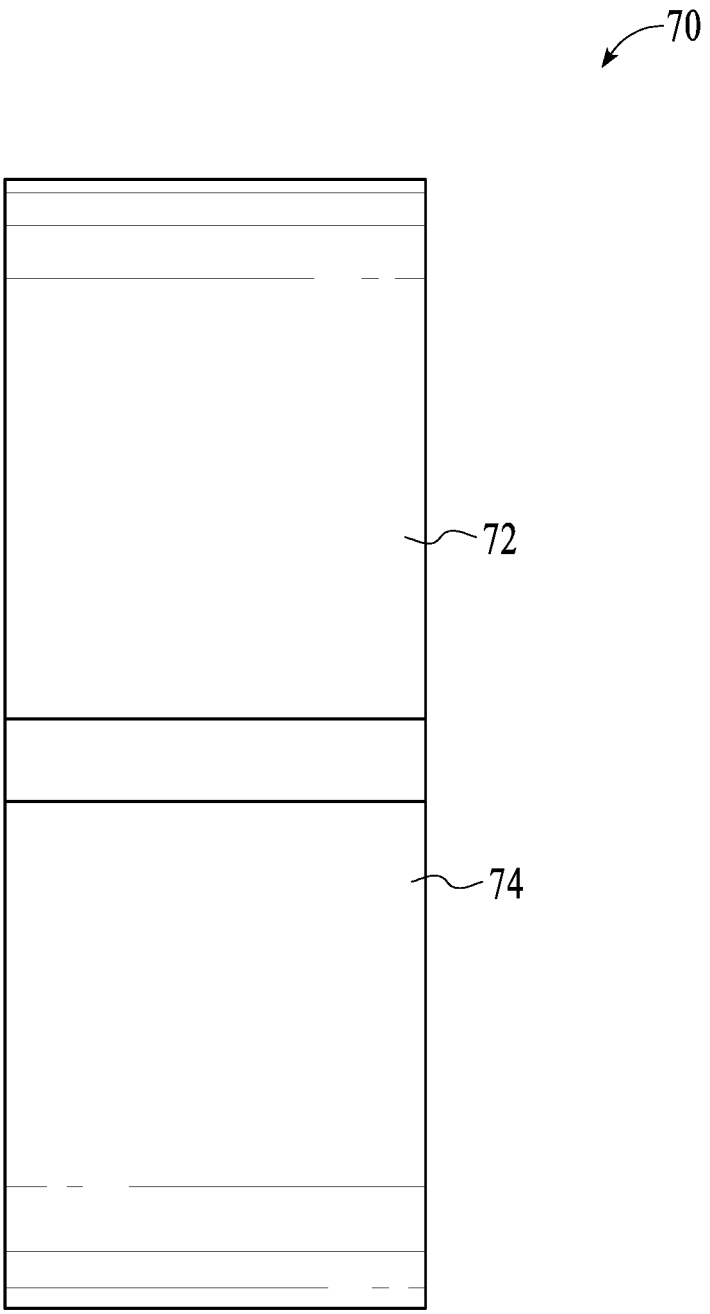
FIG. 32 is a bottom plan view of strap clasp.
Figure 33:
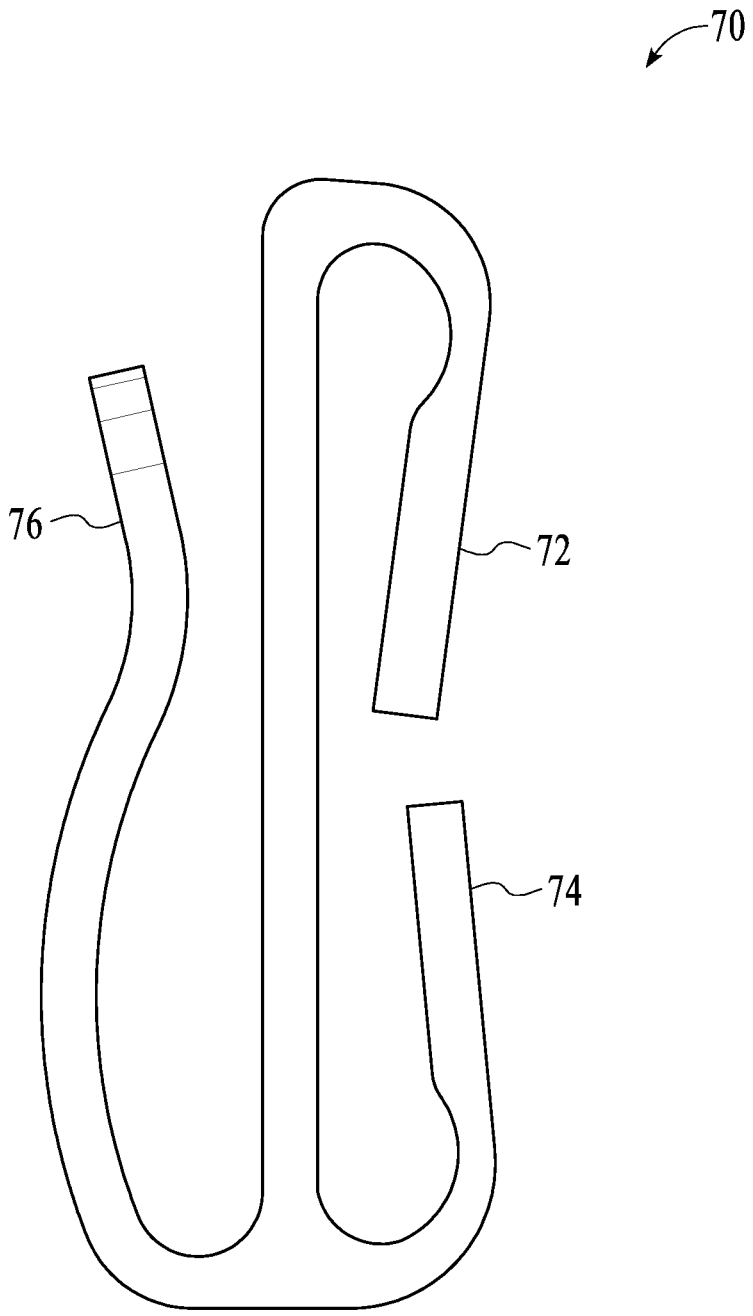
FIG. 33 is a right side elevation view of strap clasp, the left side elevation view being a mirror image thereof.
Figure 34:
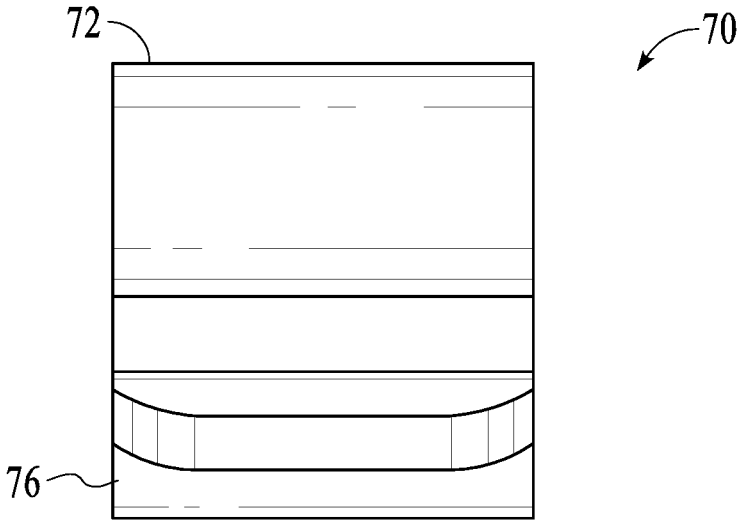
FIG. 34 is a front elevation view of strap clasp.
Figure 35:
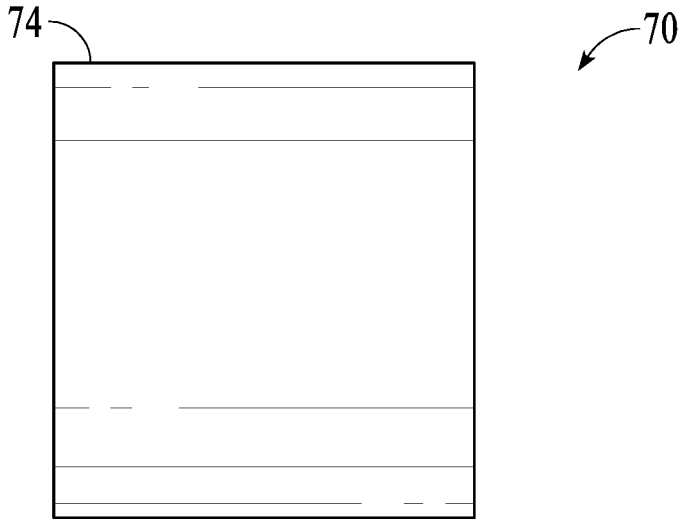
FIG. 35 is a rear elevation view of strap clasp.
Figure 36:
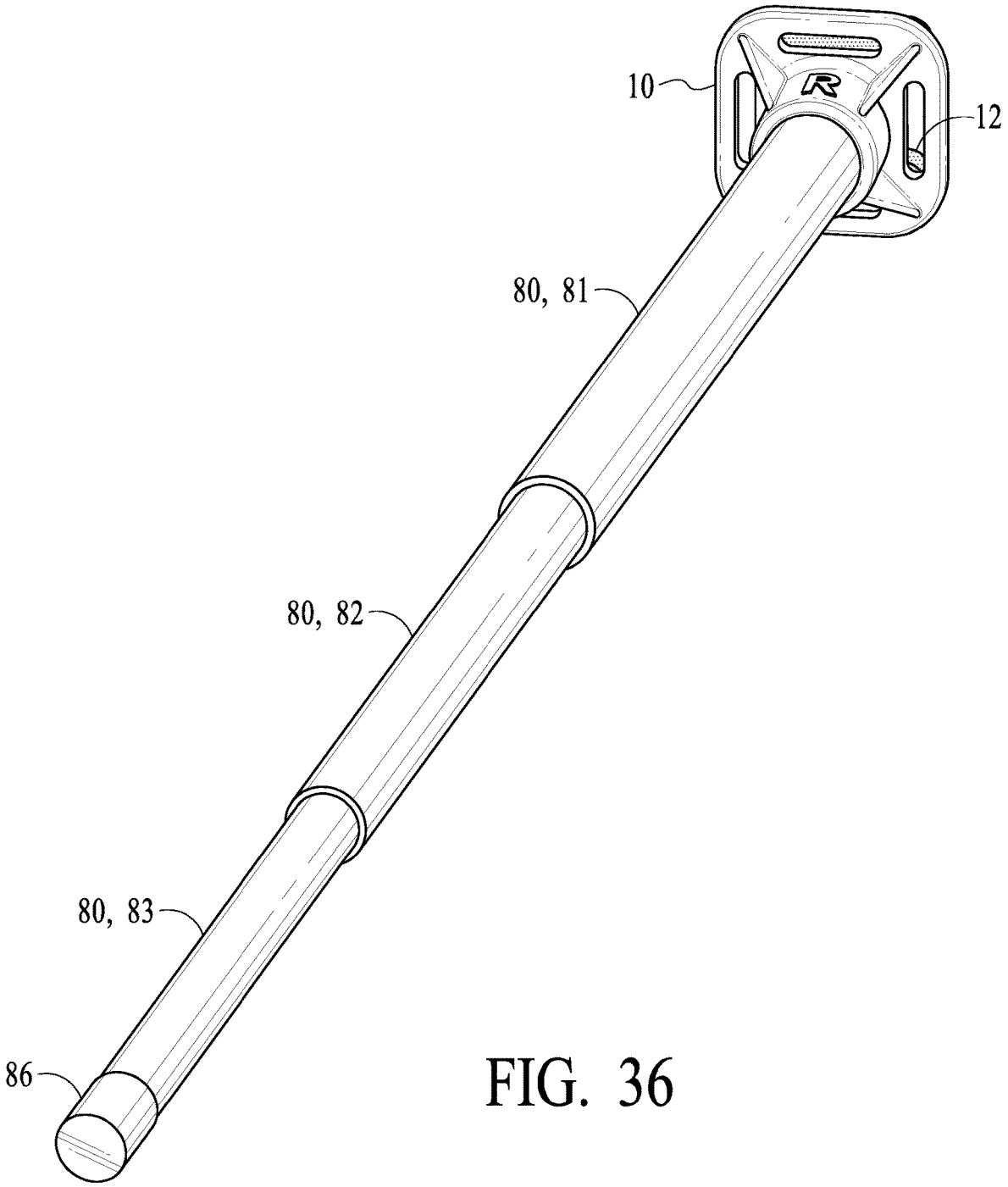
FIG. 36 is a perspective view of base member with attached rigid oblong member in the extended position.
Figure 37:
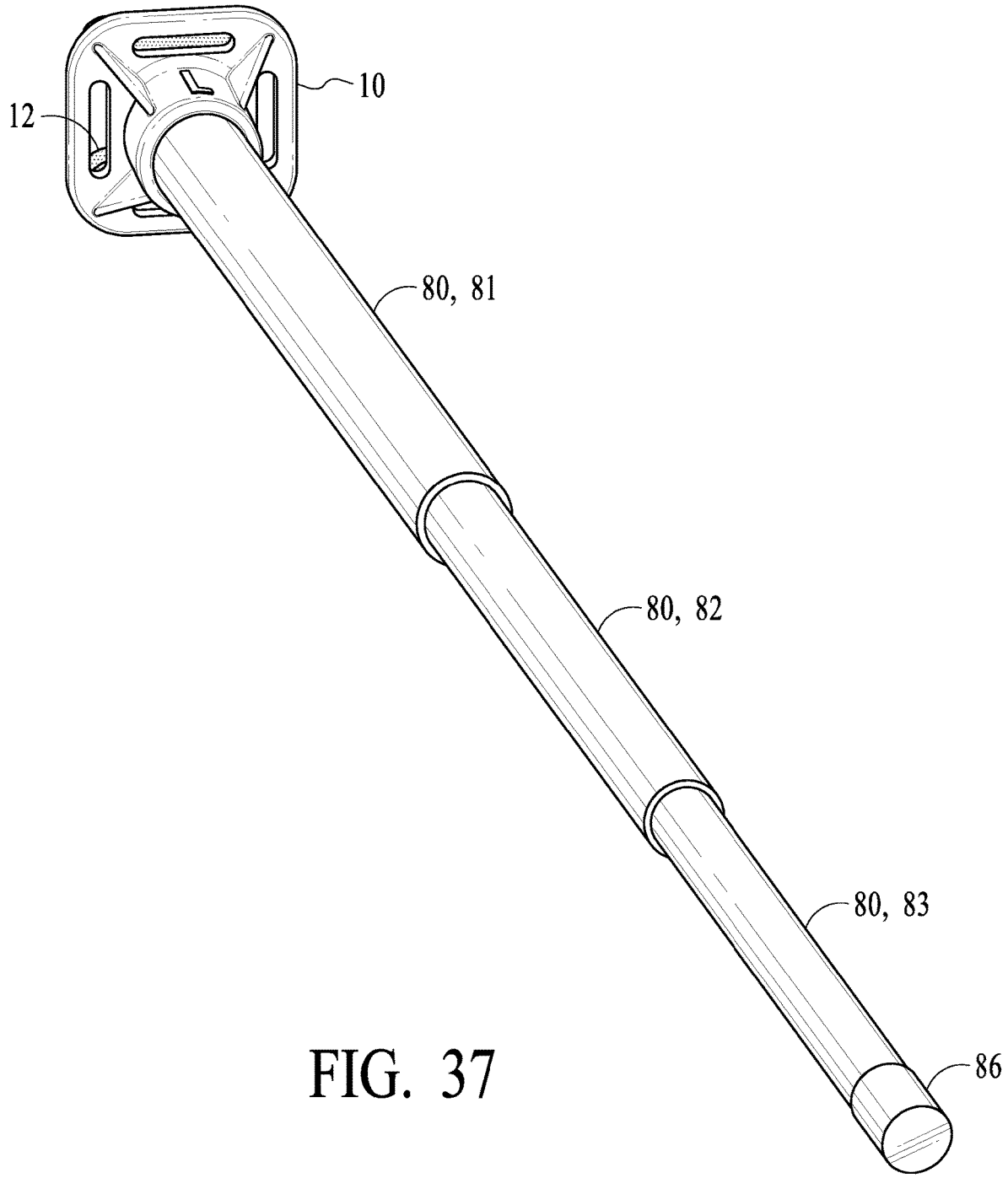
FIG. 37 is another perspective view of base member with attached rigid oblong member in the extended position.
Figure 38:
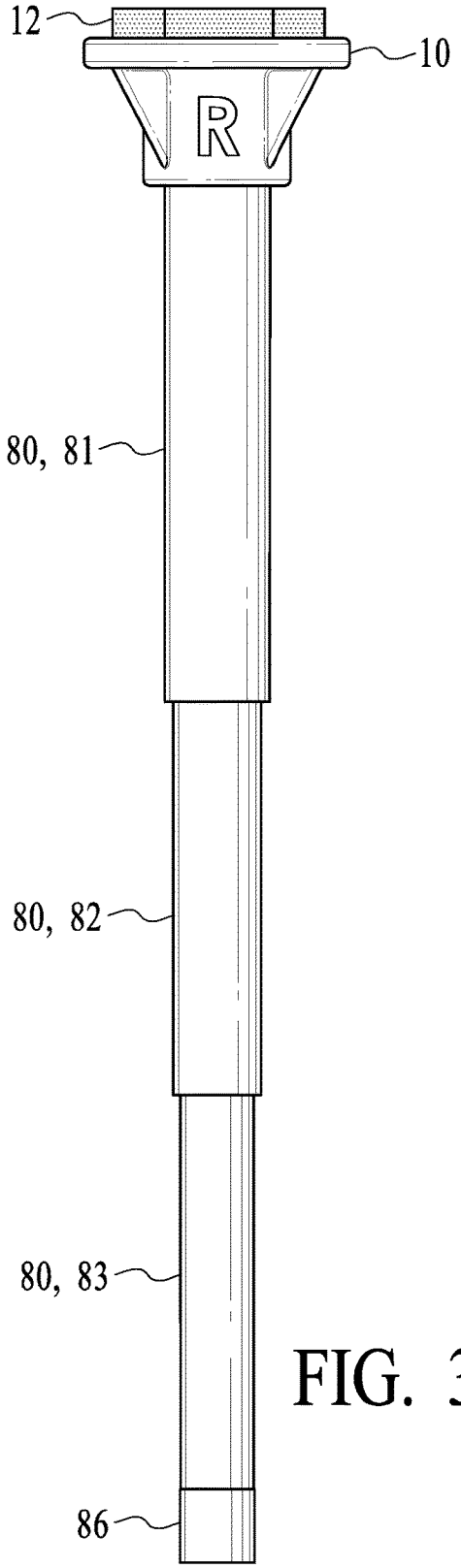
FIG. 38 is front elevation view of base member with attached rigid oblong member in the extended position.
Figure 39:
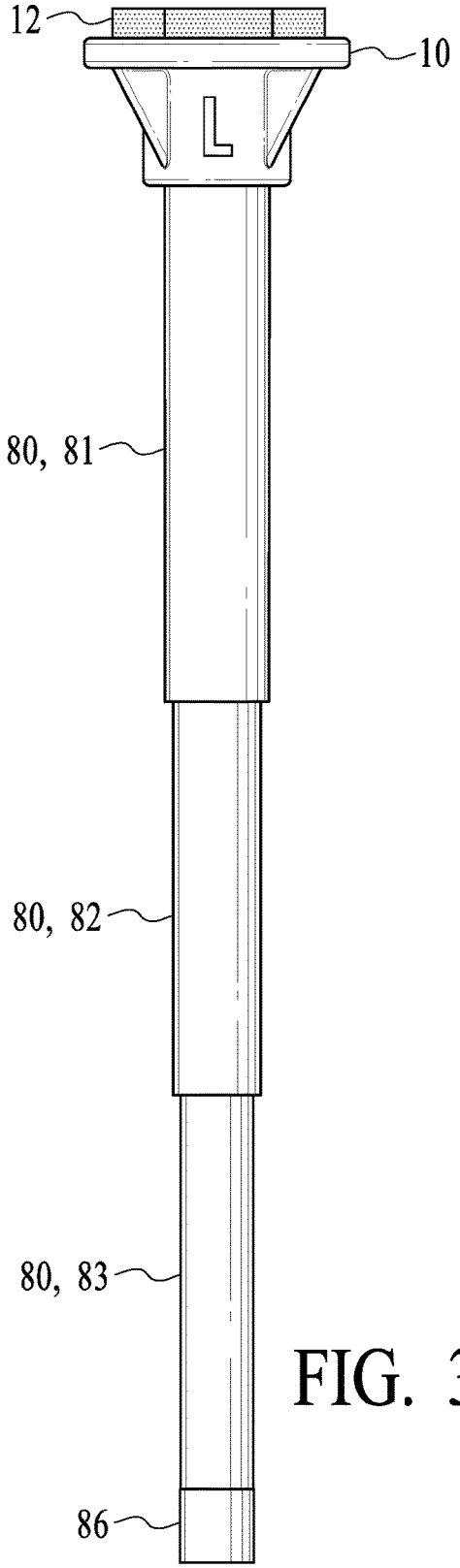
FIG. 39 is a rear elevation view of base member with attached rigid oblong member in the extended position.
Figure 40:
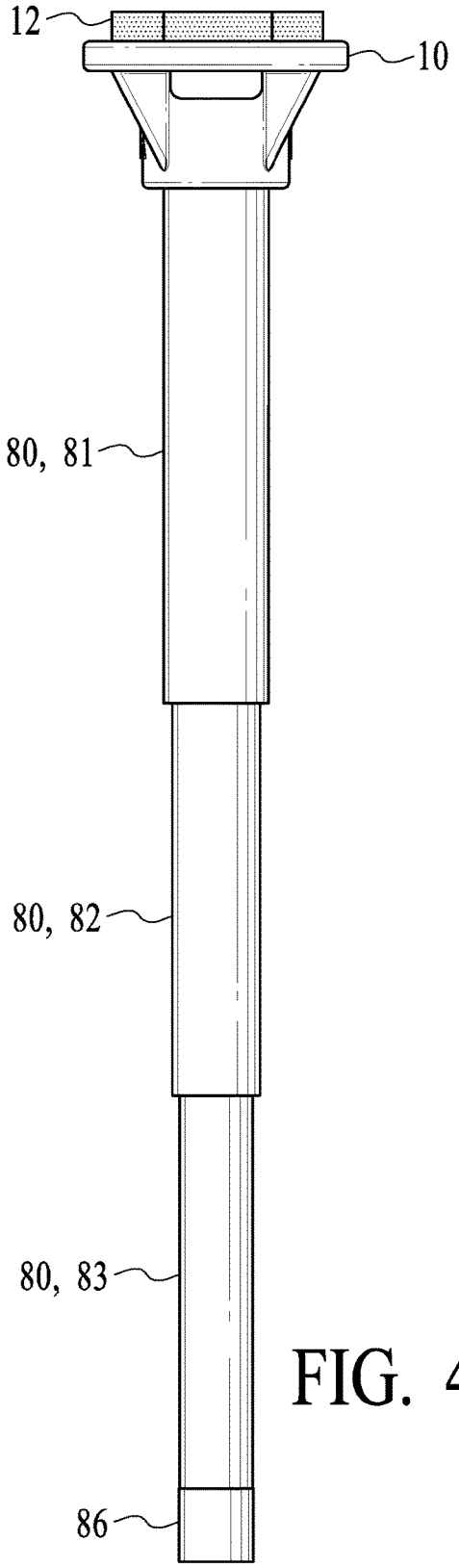
FIG. 40 is a right side elevation view of base member with attached rigid oblong member in the extended position.
Figure 41:
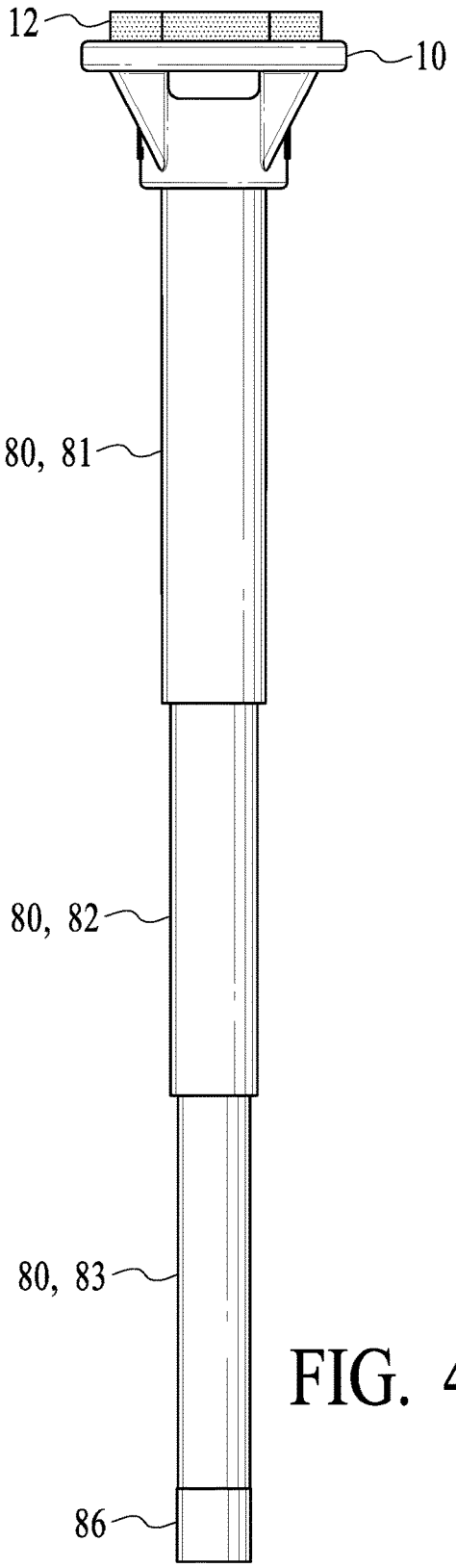
FIG. 41 is a left side elevation view of base member with attached rigid oblong member in the extended position.
Figure 42:
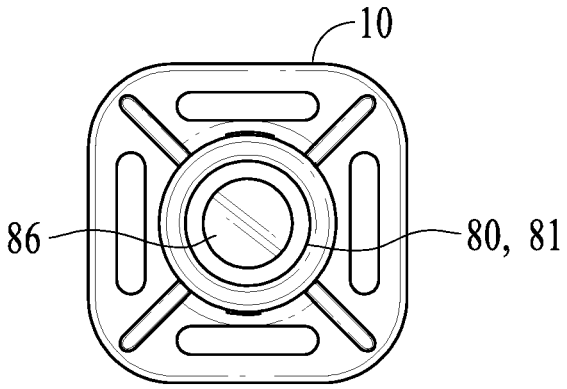
FIG. 42 is a top plan view being of base member with attached rigid oblong member in the extended position.
Figure 43:
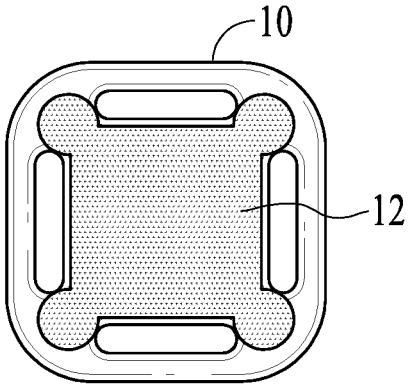
FIG. 43 is a bottom plan view of base member with attached rigid oblong member in the extended position.
Figure 44:
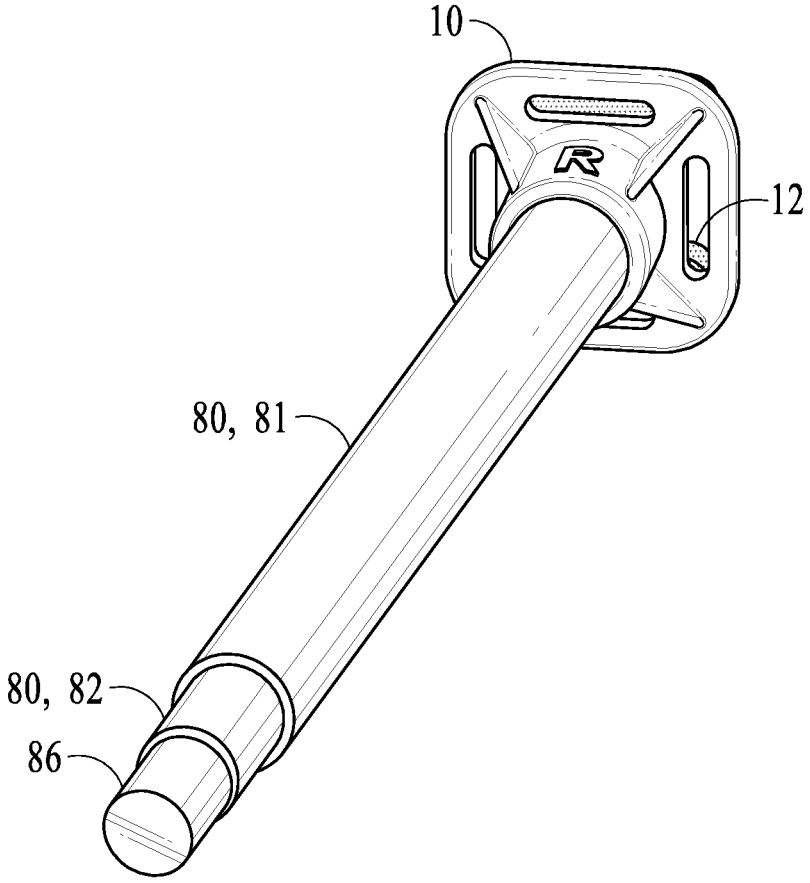
FIG. 44 is a perspective view of base member with attached rigid oblong member in the retracted position.
Figure 45:
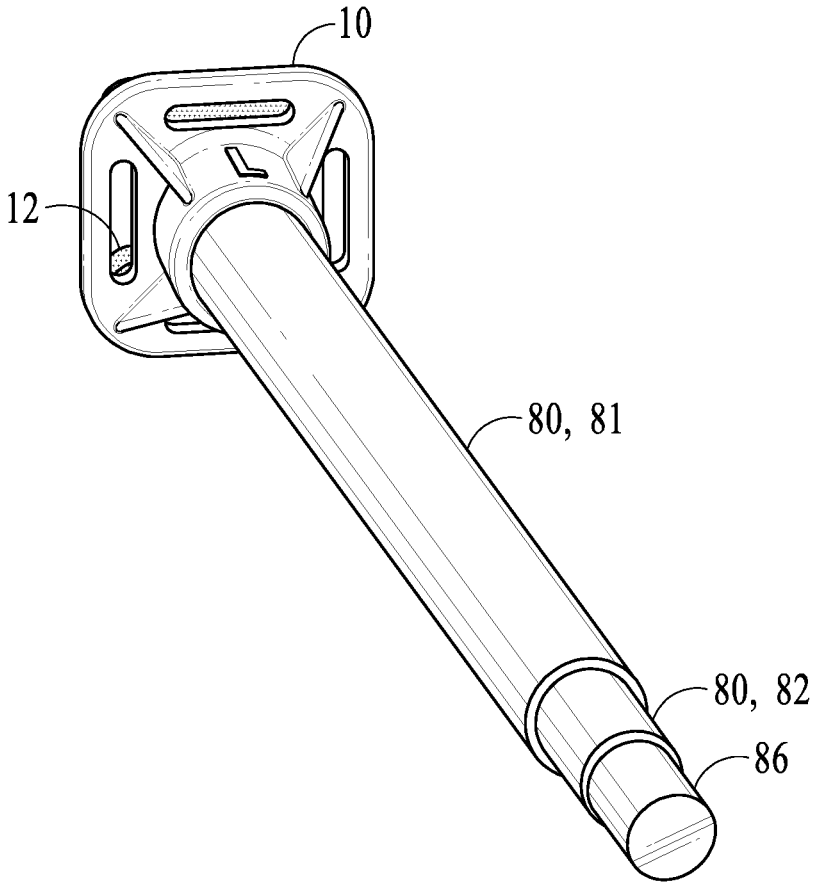
FIG. 45 is another perspective view of base member with attached rigid oblong member in the retracted position.
Figure 46:
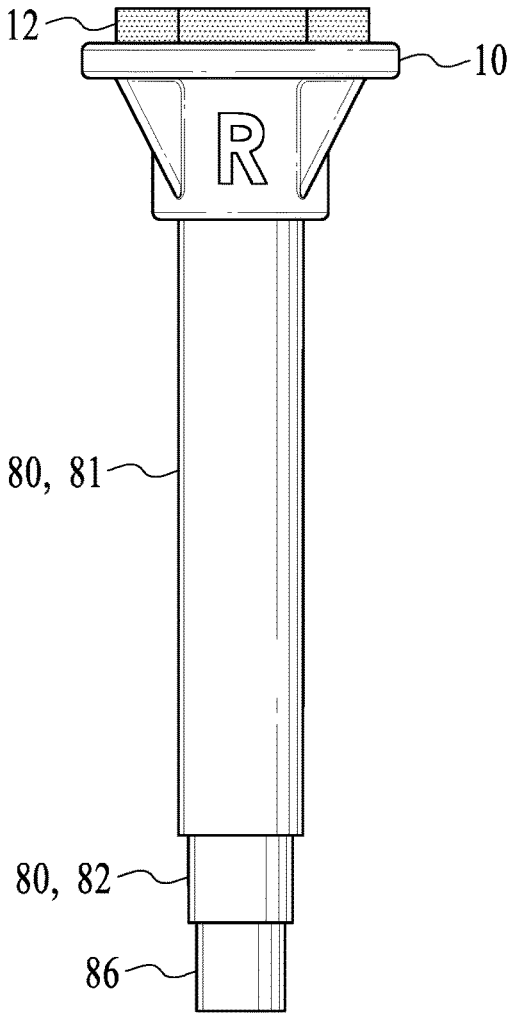
FIG. 46 is front elevation view of base member with attached rigid oblong member in the retracted position.
Figure 47:
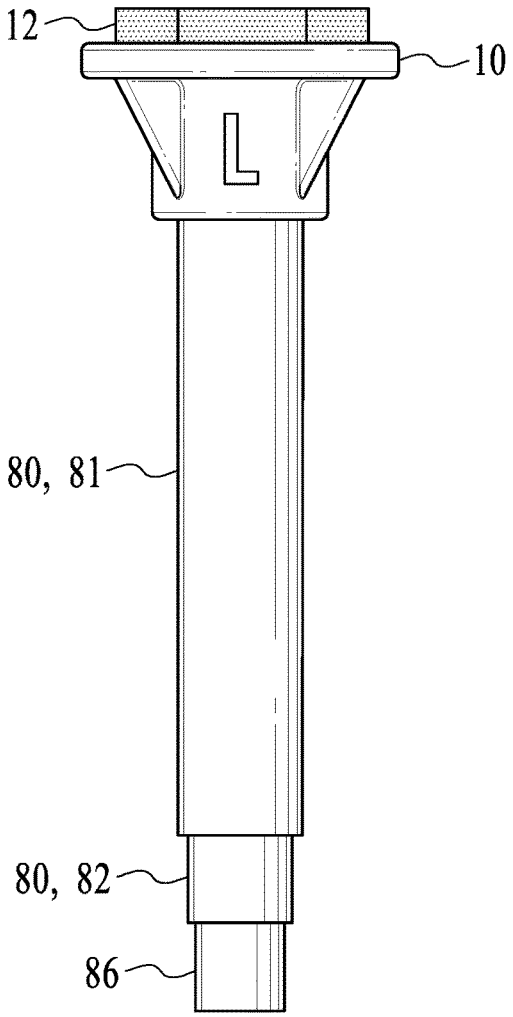
FIG. 47 is a rear elevation view of base member with attached rigid oblong member in the retracted position.
Figure 48:
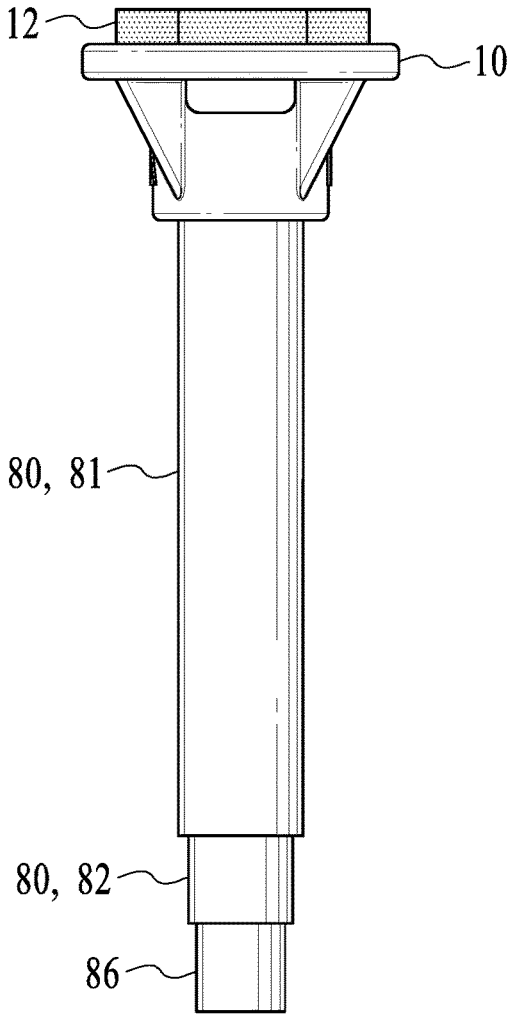
FIG. 48 is a right side elevation view of base member with attached rigid oblong member in the retracted position.
Figure 49:
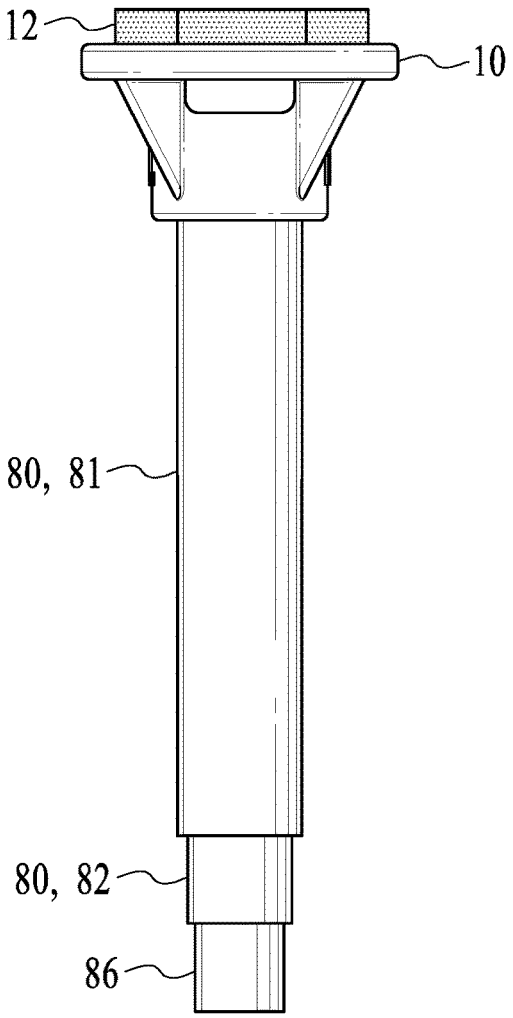
FIG. 49 is a left side elevation view of base member with attached rigid oblong member in the retracted position.
Figure 50:
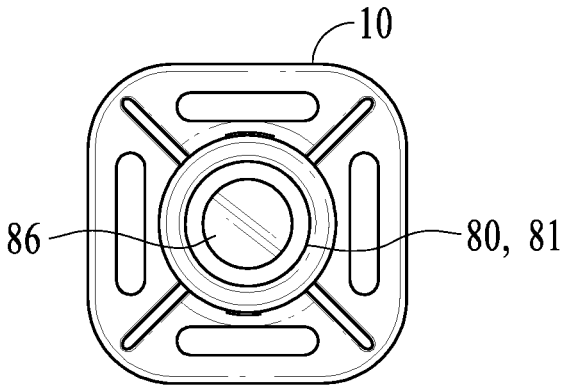
FIG. 50 is a top plan view being of base member with attached rigid oblong member in the retracted position.
Figure 51:
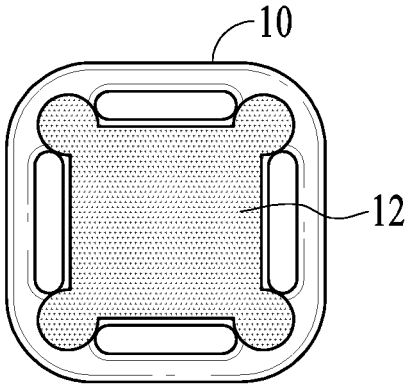
FIG. 51 is a bottom plan view of base member with attached rigid oblong member in the retracted position.
Figure 52:
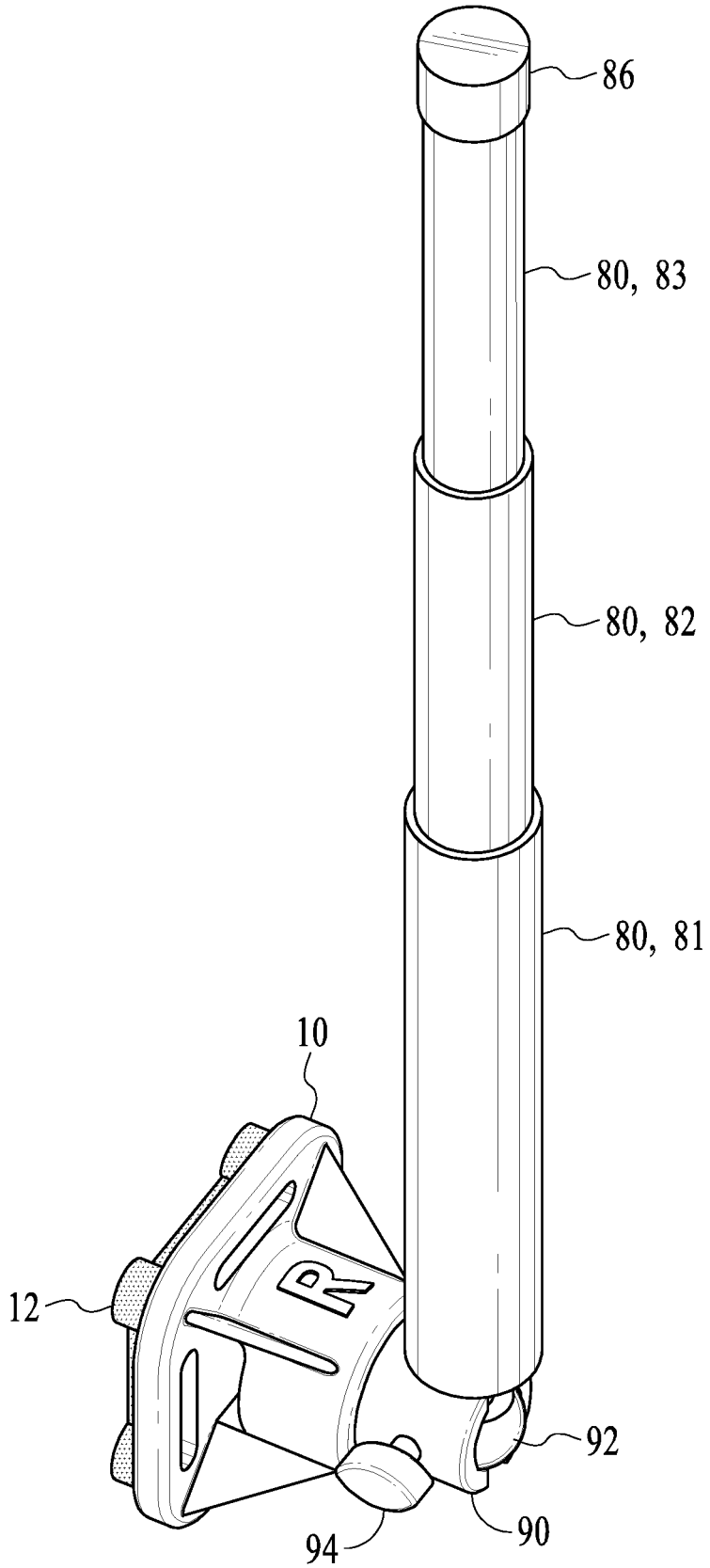
FIG. 52 is a perspective view of base member with attached adjustable hinge member and attached rigid oblong member in the extended position.
Figure 53:
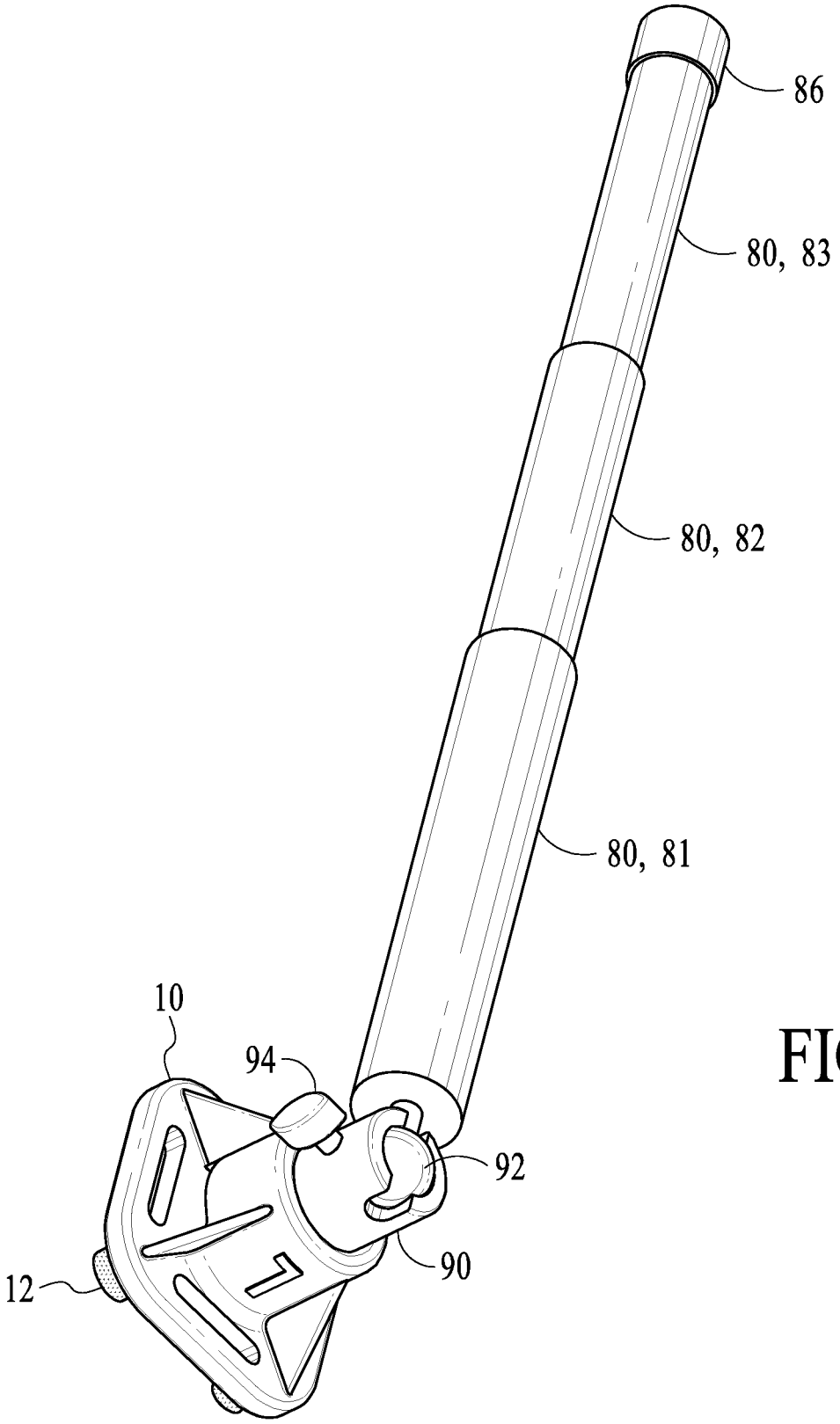
FIG. 53 is another perspective view of base member with attached adjustable hinge member and attached rigid oblong member in the extended position.
Figure 54:
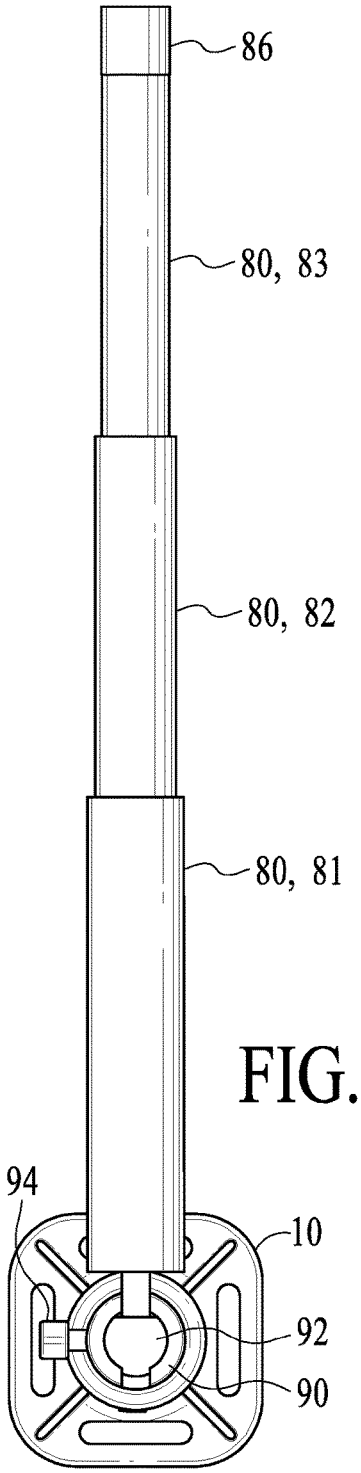
FIG. 54 is a top plan view being of base member with attached adjustable hinge member and attached rigid oblong member in the extended position.
Figure 55:
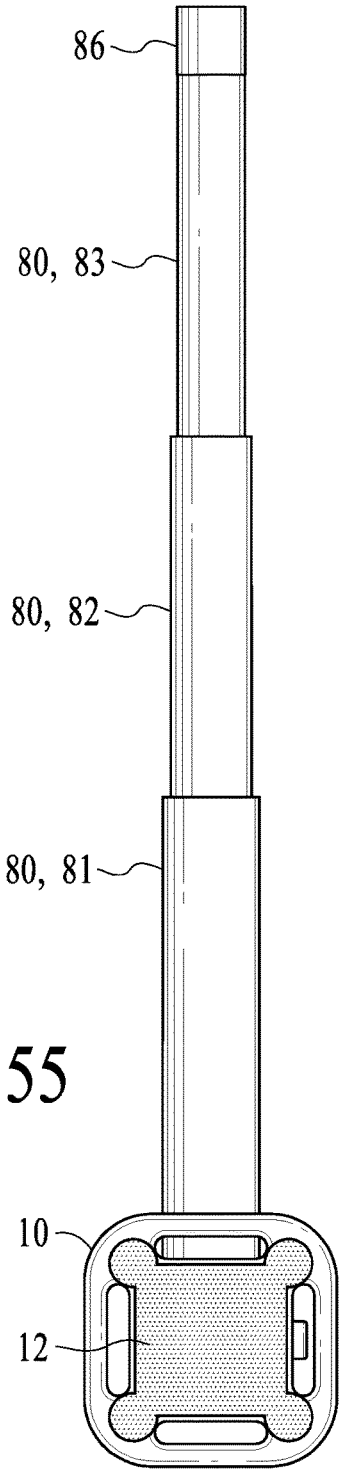
FIG. 55 is a bottom plan view of base member with attached adjustable hinge member and attached rigid oblong member in the extended position.
Figure 56:
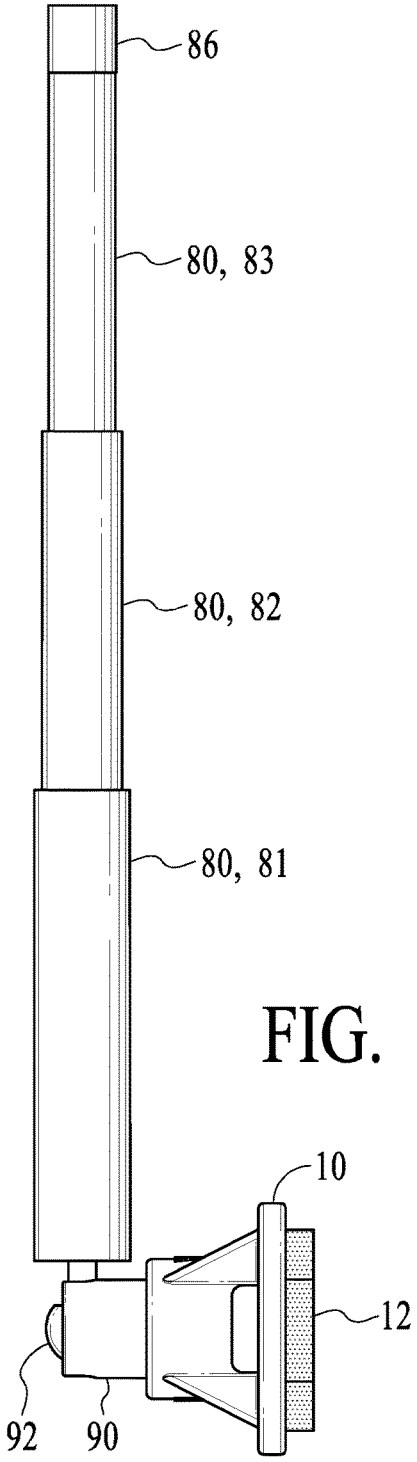
FIG. 56 is a right side elevation view of base member with attached adjustable hinge member and attached rigid oblong member in the extended position.
Figure 57:
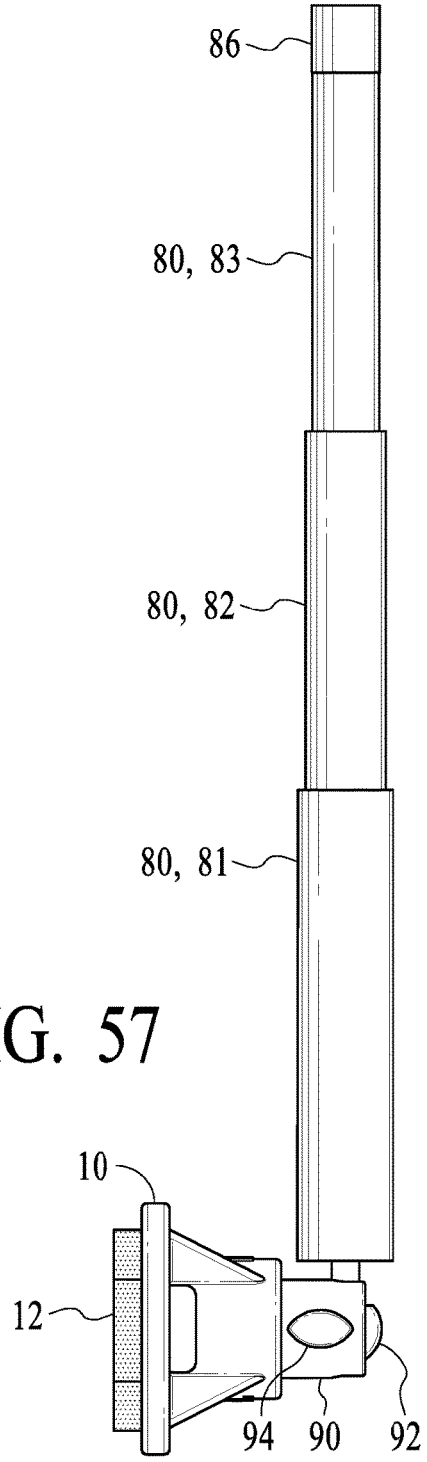
FIG. 57 is a left side elevation view of base member with attached adjustable hinge member and attached rigid oblong member in the extended position.
Figure 58:
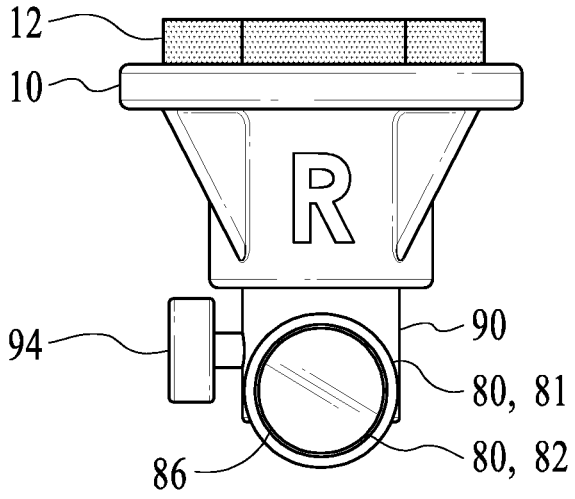
FIG. 58 is front elevation view of base member with attached adjustable hinge member and attached rigid oblong member in the extended position.
Figure 59:
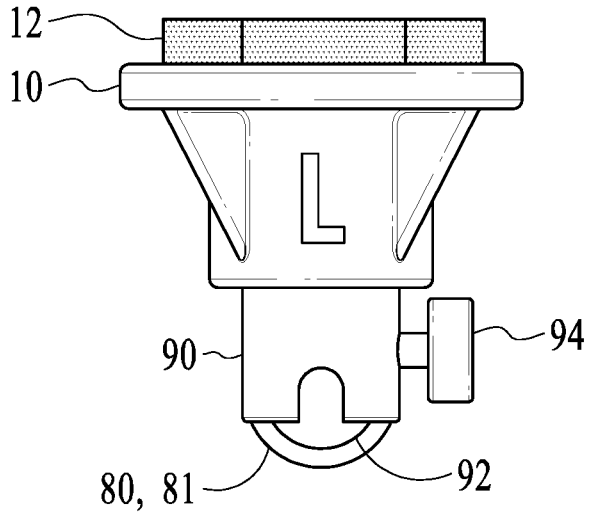
FIG. 59 is a rear elevation view of base member with attached adjustable hinge member and attached rigid oblong member in the extended position.
Figure 60:
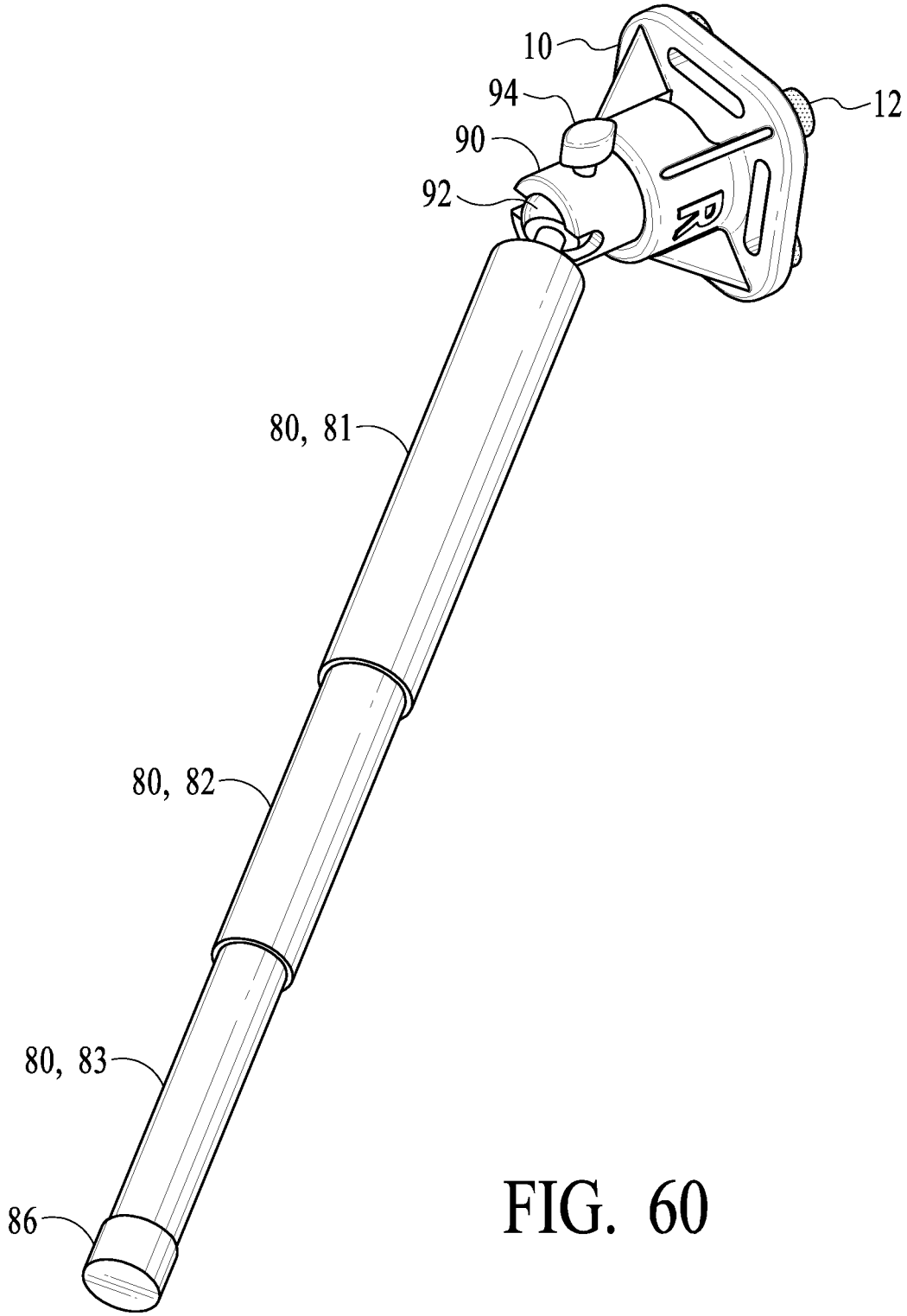
FIG. 60 is another perspective view of base member with attached adjustable hinge member and attached rigid oblong member in the extended position, depicting the universal adjustability of adjustable hinge member.
Figure 61:
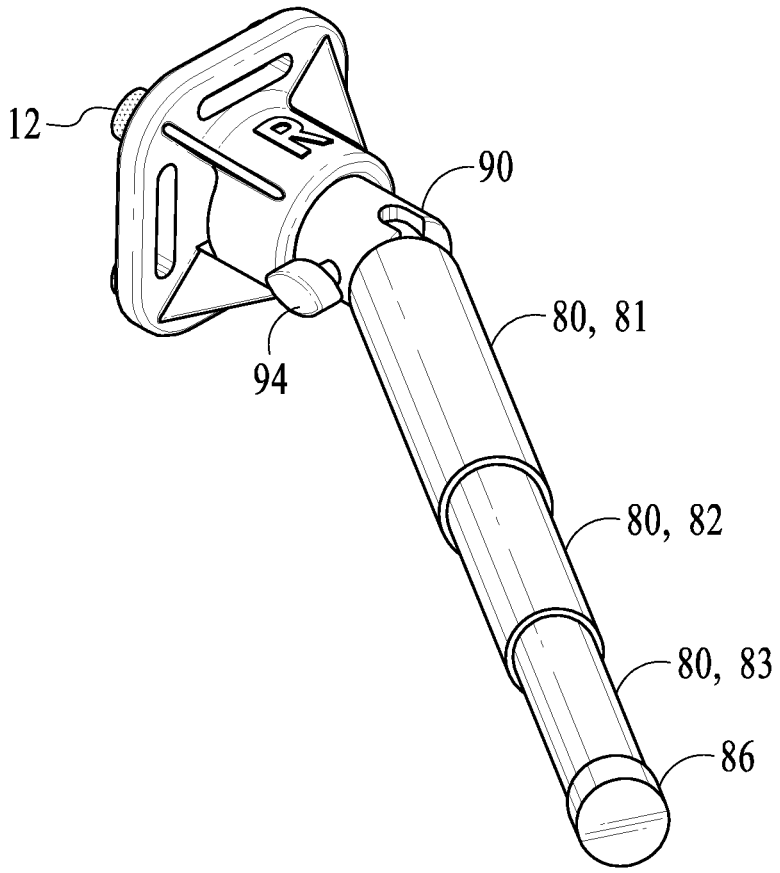
FIG. 61 is a perspective view of base member with attached adjustable hinge member and attached rigid oblong member in a semi-retracted position, depicting the universal adjustability of adjustable hinge member.
Figure 62:
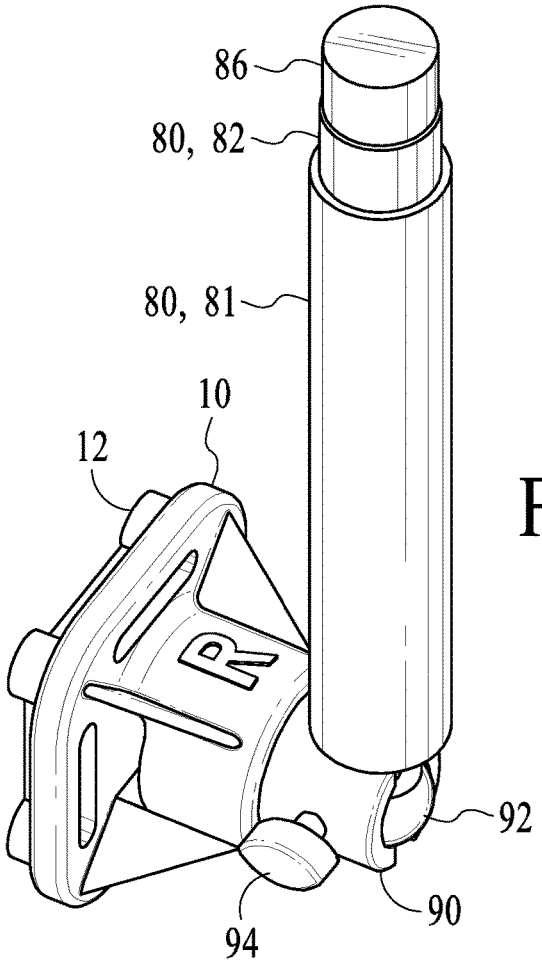
FIG. 62 is a perspective view of base member with attached adjustable hinge member and attached rigid oblong member in the retracted position.
Figure 63:
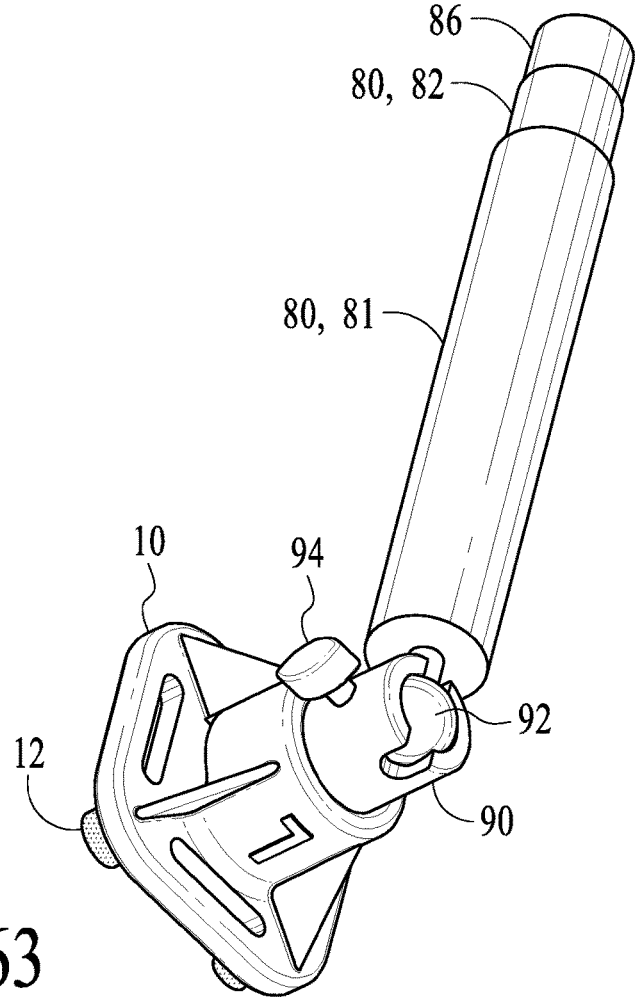
FIG. 63 is another perspective view of base member with attached adjustable hinge member and attached rigid oblong member in the retracted position.
Figure 64:
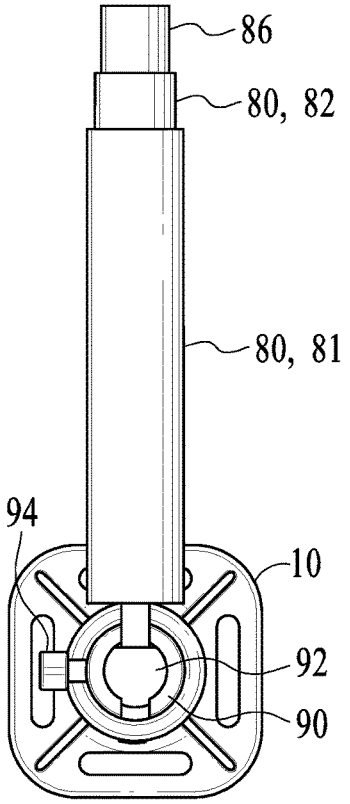
FIG. 64 is a top plan view being of base member with attached adjustable hinge member and attached rigid oblong member in the retracted position.
Figure 65:
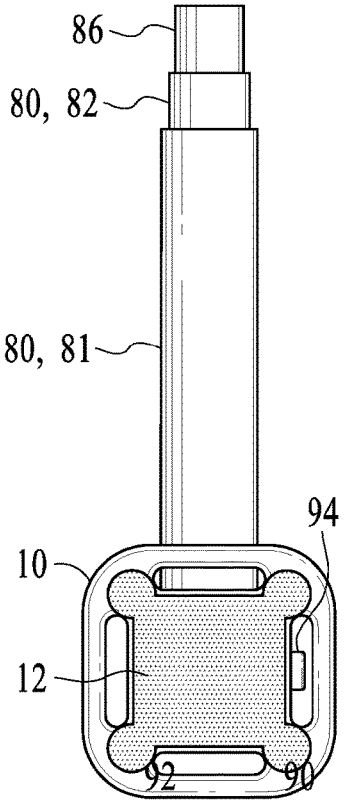
FIG. 65 is a bottom plan view of base member with attached adjustable hinge member and attached rigid oblong member in the retracted position.
Figure 66:
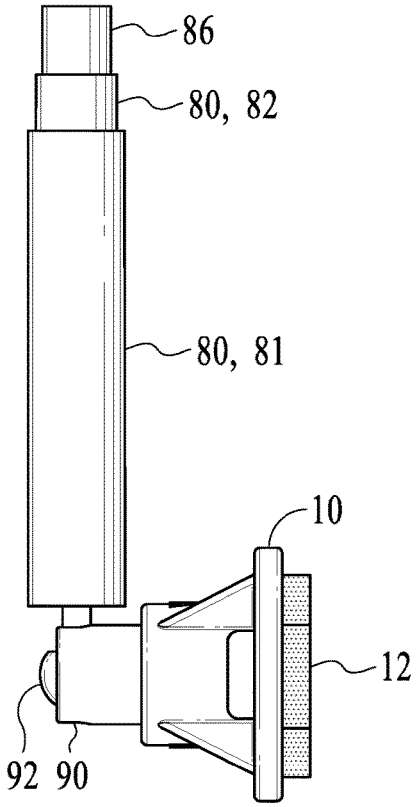
FIG. 66 is a right side elevation view of base member with attached adjustable hinge member and attached rigid oblong member in the retracted position.
Figure 67:
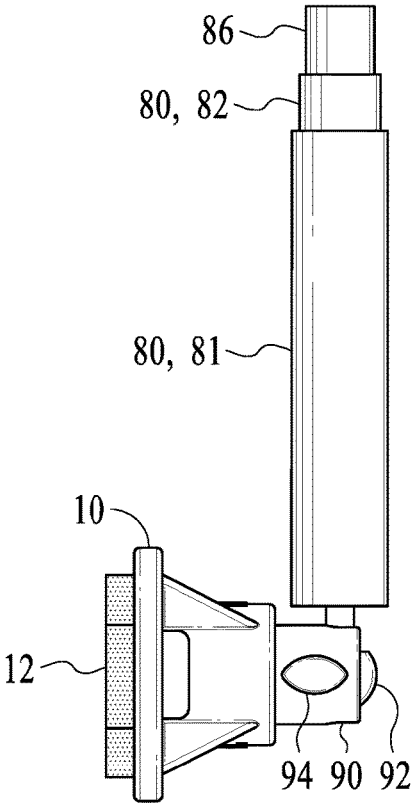
FIG. 67 is a left side elevation view of base member with attached adjustable hinge member and attached rigid oblong member in the retracted position.
Figure 68:
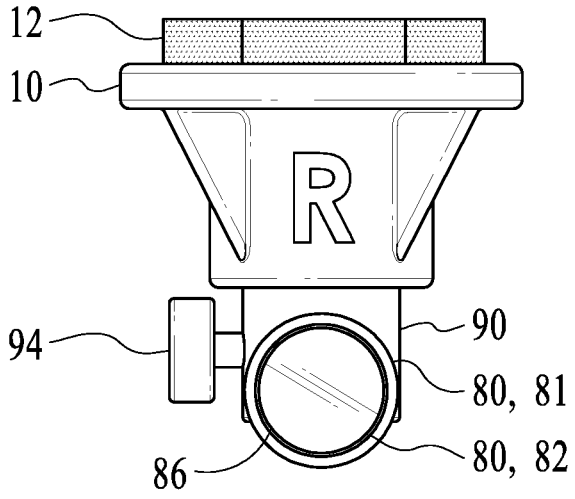
FIG. 68 is front elevation view of base member with attached adjustable hinge member and attached rigid oblong member in the retracted position.
Figure 69:
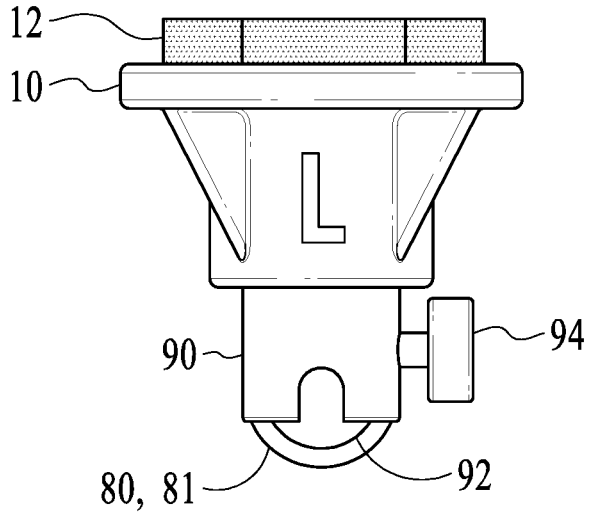
FIG. 69 is a rear elevation view of base member with attached adjustable hinge member and attached rigid oblong member in the retracted position.
Figure 70:
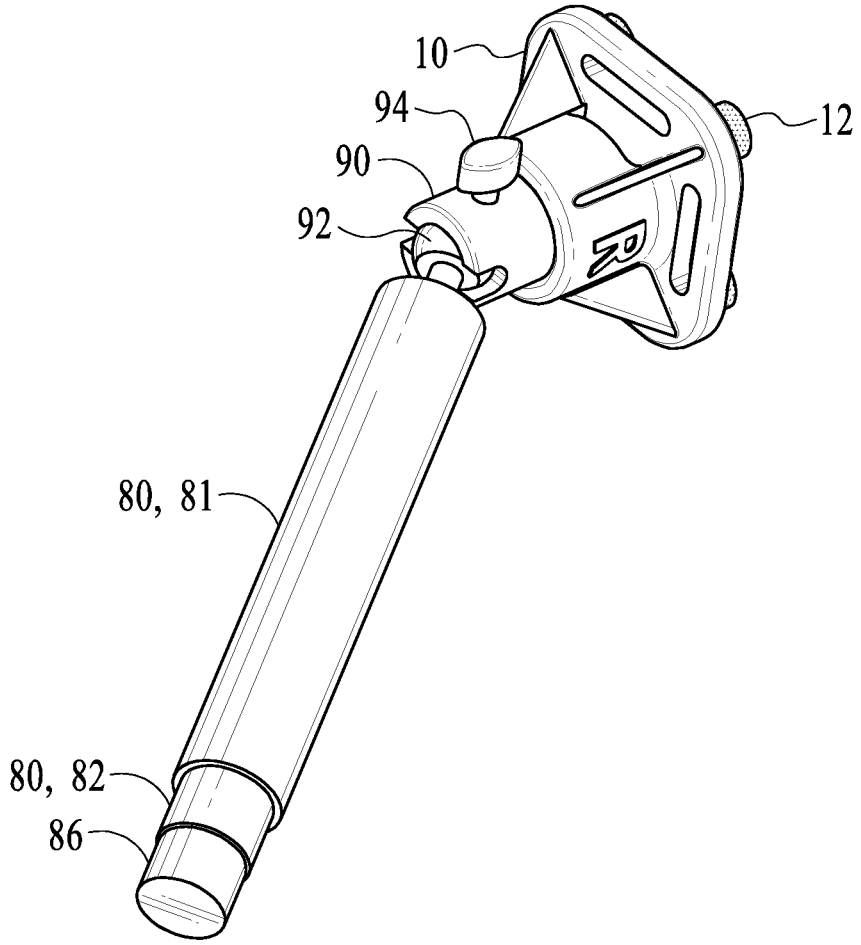
FIG. 70 is another perspective view of base member with attached adjustable hinge member and attached rigid oblong member in the retracted position, depicting the universal adjustability of adjustable hinge member.
Figure 71:
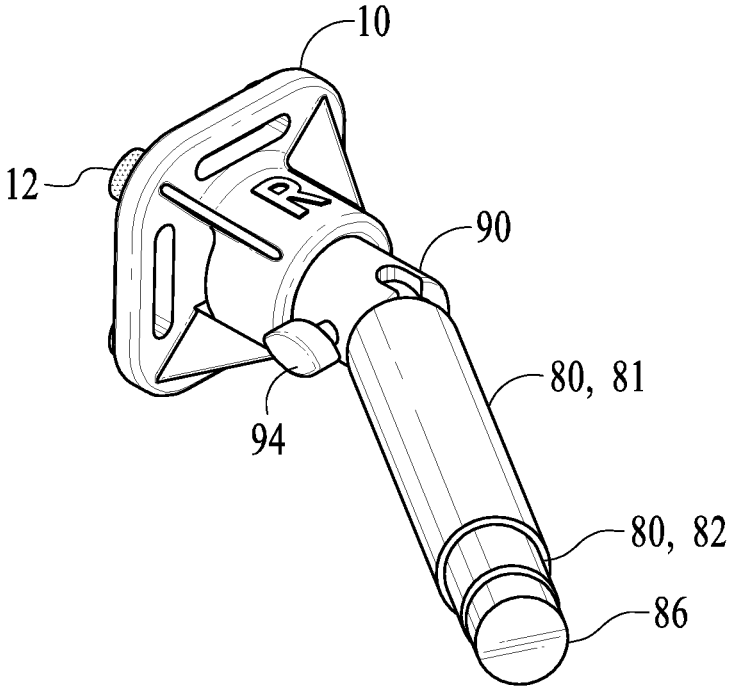
FIG. 71 is another perspective view of base member with attached adjustable hinge member and attached rigid oblong member in the retracted position, depicting the universal adjustability of adjustable hinge member.

| Term | Definition |
|---|---|
| 5 | Swing Guide Device |
| 10 | Base Member |
| 11 | Pedestal |
| 12 | Pedestal Pad |
| 13 | Socket |
| 14 | Strap Tunnel |
| 15 | First Slot |
| 16 | Second Slot |
| 17 | Third Slot |
| 18 | Fourth Slot |
| 19 | Gusset |
| 20 | Vertical Strap |
| 22 | Vertical Strap Hook and Loop Attachment Area |
| 30 | Upper Connector |
| 32 | Upper Connector Hook |
| 34 | Upper Connector Strap Slot |
| 40 | Horizontal Strap |
| 42 | Horizontal Strap Hook and Loop Attachment Area |
| 50 | First Connector |
| 52 | First Connector Hook |
| 54 | First Connector Elongated Base |
| 56 | First Connector Strap Slot |
| 60 | Second Connector |
| 62 | Second Connector Hook |
| 64 | Second Connector Elongated Base |
| 66 | Second Connector Strap Slot |
| 70 | Strap Clasp |
| 72 | Strap Clasp First Lower Wing |
| 74 | Strap Clasp Second Lower Wing |
| 76 | Strap Clasp Upper Wing |
| 78 | Adjustment Wedge |
| 80 | Pole or Rigid Oblong Member |
| 81 | First Segment |
| 82 | Second Segment |

-continued

| Term | Definition |
|---|---|
| 83 | Third Segment |
| 86 | Electronic Tip |
| 90 | Adjustable Hinge Member |
| 92 | Hinge Joint |
| 94 | Set Screw |
| 100 | Baseball Helmet or Softball Helmet |
| 102 | Upper Vent Hole |
| 104 | Left Ear Hole |
| 106 | Right Ear Hole |
| 110 | Baseball or Softball Bat |
| 112 | Baseball or Softball |

DETAILED DESCRIPTION OF THE INVENTION

Swing guide device 5 comprises: a base member 10; a vertical strap 20; a horizontal strap 40; an upper connector 30; a first connector 50; a second connector 60; and a pole or rigid oblong member 80. Swing guide 5 device is reversibly rigidly attachable to a baseball helmet or softball helmet 100 with straps 20,40 and connectors 30,40,50 that reversibly attach to ear holes 104,106 and an upper vent hole 102 on the baseball helmet or softball helmet 100. The baseball helmet or softball helmet 100 is not a part of this invention.

Base member 10 comprises: a pedestal 11; a pedestal pad 12; a socket 13; a strap tunnel 14; a first slot 15; a second slot 16; a third slot 17; and a fourth slot 18.

Pedestal 11 is a rigid planar member with a length, a width, a thickness, a first edge, a second edge, a third edge, a fourth edge, an outer surface, an inner service, a horizontal axis, and a vertical axis. The horizontal axis of pedestal 11 is coincident with the plane of the rigid planar member.

Pedestal pad 12 is a resilient planar member with an outer surface and an inner surface. The outer surface of pedestal pad 12 is rigidly attached to the inner surface of pedestal 11. Pedestal pad 12 functions as a cushion between the base member 10 and the baseball or softball helmet 100 which improves traction and provides shock absorption between these members.

Socket 13 is a rigid hollow cylindrical member with an inner diameter, an outer diameter, an inner surface, an outer surface, a length, a side, a first end, a second end, and a longitudinal axis. The first end of socket 13 is closed. The second end of socket 13 is open. The first end of socket 13 is rigidly attached to the outer surface of the pedestal 11 so that the longitudinal axis of socket 13 is perpendicular to the plane of the pedestal 11. Rigid attachment may be accomplished by any know means. In best mode, socket 13 is integral with pedestal 11 and constructed from the same piece of material. The inner diameter of socket 13 is sized to make a friction fit with the outer diameter of the pole or rigid oblong member 80 and the outer diameter of adjustable hinge member 90. Socket 13 functions to engage with pole or rigid oblong member 80 or adjustable hinge member 90 to rigidly attach the pole or rigid oblong member 80 or adjustable hinge member 90 to the socket 13. The second end of socket 13 receives the first end of pole or rigid oblong member 80, or alternately, the first end of the segment 81 of pole or rigid oblong member 80 to rigidly attach these two members together. Still alternately, the second end of socket 13 receives the first end of adjustable hinge member 90 to rigidly attach these two members together. In best mode, the first end of the first segment 81 or first end of pole or rigid oblong member 80 is permanently glued, epoxied, or welded within the second end of socket 13; or alternately, the first end of adjustable hinge member 90 is permanently glued, epoxied, or welded within the second end of socket 13.

Strap tunnel 14 is a clearance passage, shaft, or tunnel in between the first end of socket 13 and the outer surface of pedestal 11. Socket 13 is rigidly attached to the outer surface of the pedestal 11 so that socket 13 is raised above or held above the outer surface of pedestal 11 to yield clearance for the horizontal strap 40 to pass between the first end of socket 13 and the outer surface of pedestal 11. Thus, socket 13 is connected to pedestal 11 with clearance therebetween to create socket 13 as depicted. In best mode, socket 13 is attached to the outer surface of the pedestal 11 with four gussets 19. Each gusset 19 is a rigid planar triangular-shaped member. The four gussets 19 are equally spaced around the outer diameter of socket 13 as depicted in order to firmly and rigidly connect socket 13 to base member 10 with strap tunnel 14 running between socket 13 and base member 10. In best mode, pedestal 11, socket 13, and gussets 19 are integral and constructed from the same piece of material. Strap tunnel 14 tunnel has a width, a length, height, and longitudinal axis. The longitudinal axis of strap tunnel 14 is parallel with the horizontal axis of the pedestal 11. The width of strap tunnel 14 is greater than the width of horizontal strap 40. The length of strap tunnel 14 is greater than the outer diameter of socket 13. The height of strap tunnel 14 is greater than the thickness of horizontal strap 40. Strap tunnel 14 functions to engage with and receive horizontal strap 40 which passes through the strap tunnel 14 as depicted. Strap tunnel 14 and horizontal strap 40 help hold the pedestal 11 firmly onto the baseball or softball helmet 100.

First slot 15 is an aperture, slit, slot, or elongated opening in pedestal 11. First slot 15 has a width, length, an outer surface, an inner surface, and longitudinal axis. First slot 15 is located adjacent to the first edge of pedestal 11 with its longitudinal axis parallel with the first edge of pedestal 11. The width of first slot 15 is slightly greater than the thickness of horizontal strap 40. The length of first slot 15 is slightly greater than the width of horizontal strap 40. First slot 15 functions to engage with and receive horizontal strap 40 which passes through the first slot 15 as depicted. Horizontal strap 40 passes through the first and third slots 15,17 in both the left-handed batter configuration and the right-handed batter configuration.

Second slot 16 is an aperture, slit, slot, or elongated opening in the pedestal 11. Second slot 16 has a width, length, an outer surface, an inner surface, and longitudinal axis. Second slot 16 is located adjacent to the second edge of pedestal 11 with its longitudinal axis parallel with the second edge of pedestal 11. The width of second slot 16 is slightly greater than the thickness of vertical strap 20. The length of second slot 16 is slightly greater than the width of vertical strap 20. Second slot 16 functions to engage with and receive vertical strap 20 which passes through the second slot 16 as depicted. The vertical strap 20 passes through the second slot 16 in the right-handed batter configuration as depicted. The vertical strap 20 passes through the fourth slot 18 in the left-handed batter configuration. Thus, swing guide device may be configured for both left and right-handed batters.

Third slot 17 is an aperture, slit, slot, or elongated opening in the pedestal 11. Third slot 17 has a width, length, an outer surface, an inner surface, and longitudinal axis. Third slot 17 is located adjacent to the third edge of pedestal 11 with its longitudinal axis parallel with the third edge of pedestal 11. The width of third slot 17 is slightly greater than the thickness of horizontal strap 40. The length of third slot 17 is slightly greater than the width of horizontal strap 40. Third slot 17 functions to engage with and receive horizontal strap 40 which passes through the third slot 17 as depicted. Horizontal strap 40 passes through the first and third slots 15,17 in both the left-handed batter configuration and the right-handed batter configuration.

Fourth slot 18 is an aperture, slit, slot, or elongated opening in the pedestal 11. Fourth slot 18 has a width, length, an outer surface, an inner surface, and longitudinal axis. Fourth slot 18 is located adjacent to the fourth edge of pedestal 11 with its longitudinal axis parallel with the fourth edge of pedestal 11. The width of fourth slot 18 is slightly greater than the thickness of vertical strap 20. The length of fourth slot 18 is slightly greater than the width of vertical strap 20. Fourth slot 18 functions to engage with and receive vertical strap 20 which passes through the fourth slot 18 in the left-handed batter configuration as depicted. Thus, swing guide device may be used for both left and right-handed batters.

Vertical strap 20 is a flexible band, belt, strap, or tape member. Vertical strap 20 has a first end, a second end, a length, a width, a thickness, a longitudinal axis, and a latitudinal axis. Vertical strap 20 functions to connect the base member 10 to an upper vent hole 102 in the baseball or softball helmet 100. There is an upper vent hole 102 on most baseball or softball helmets 100. The first end of vertical strap 20 is attached to second slot 16 for right-handed configuration and the fourth slot 18 for left-handed configuration. As discussed below, the second end of vertical strap 20 is attached to the upper connector 30 which is reversibly attachable to the upper vent hole 102 on a baseball or softball helmet 100.

Upper connector 30 is a rigid U-shaped clip, catch, clasp, fastener, or hook. Upper connector 30 has an upper connector hook 32 which is a rigid hook-shaped member that hooks onto an upper vent hole 102 of a baseball or softball helmet 100. Upper connector 30 further comprises an upper connector strap slot 34. Upper connector strap slot 34 is an aperture, slit, slot, or elongated opening that is rigidly attached to upper connector hook 32. Upper connector strap slot 34 has a longitudinal axis that perpendicular to the plane of curvature of the hook on upper connector hook 32. Upper connector strap slot 34 functions as a permanent attachment point between the second end of vertical strap 20 and the upper connector hook 32 wherein the second end of vertical strap 20 is threaded through upper connector strap slot 34, looped around, and attached to itself to form a permanent loop to permanently attach the upper connector 30 to the second end of vertical strap 20. In best mode permanent attachment is done by sewing as depicted.

The first end of vertical strap 20 is reversibly adjustably attachable to the second or fourth slot of base member 10. As stated, the second slot is used in the right-handed batter configuration and the fourth slot is used in the left-handed batter configuration. The first end of vertical strap 20 includes a means of reversible adjustable attachment to the second slot or fourth slot on base member 10. Any known means of reversible adjustable attachment may be used. In best mode, the first end of vertical strap 20 has a vertical strap hook and loop attachment area 22 to provide a means of reversible adjustable attachment to the second slot or fourth slot on base member 10 wherein the first end of vertical strap 20 is threaded through upper connector strap slot 34 and then looped back and attached to itself with the vertical strap hook and loop attachment area 22 to complete the reversible adjustable attachment.

Horizontal strap 40 is a flexible band, belt, strap, or tape member. Horizontal strap 40 has a first end, a second end, a length, a width, a thickness, a longitudinal axis, and a latitudinal axis. Horizontal strap 40 functions to connect the base member 10 to a left ear hole 104 and a right ear hole 106 in the baseball or softball helmet 100. There is a left and right ear hole 104,106 on most baseball or softball helmets 100. As discussed below, the first end of horizontal strap 40 is attached to the first connector 50 which is reversibly attachable to the left ear hole 104 on a baseball or softball helmet 100 and the second end of horizontal strap 40 is attached to the second connector 60 which is reversibly attachable to the right ear hole 106 on a baseball or softball helmet 100.

First connector 50 is a rigid U-shaped clip, catch, clasp, fastener, or hook. First connector 50 has a first connector hook 52 which is a rigid hook-shaped member that hooks onto the left ear hole 104 of a baseball or softball helmet 100 for a right-handed batter configuration or alternately hooks onto the right ear hole 106 of a baseball or softball helmet 100 for a left-handed batter configuration. In best mode, first connector hook 52 is a rigid hook-shaped member with an ear member or flange member at the end of the hook. Ear member or flange member is a rigid tab that projects outward in the opposite direction of the curvature on the hook-shaped member as depicted. Ear member or flange member functions to help guide the hook-shaped member into the right or left ear hole 104,106 of the baseball or softball helmet 100. This rigid tab member allows the first connector hook 52 to more easily slide into right or left ear hole 104,106 and then firmly hook itself onto the right or left ear hole 104,106.

First connector 50 further comprises: a first connector elongated base 54 and a first connector strap slot 56. First connector elongated base 54 is a rigid rectangular planar member with a first end and a second end. The first end of first connector elongated base 54 is rigidly attached to first connector hook 52. The second end of first connector elongated base 54 is rigidly attached to first connector strap slot 56. First connector elongated base 54 functions to provide distance between first connector hook 52 and the first connector strap slot 56. This distance provides more leverage on first connector hook 52 and allows for a more rigid and sturdy attachment between first connector hook 52 and ear holes 104,106. First connector elongated base 54 allows vertical strap 20 to pull first connector 50 more firmly against the baseball helmet or softball helmet 100.

First connector strap slot 56 is an aperture, slit, slot, or elongated opening in first connector elongated base 54. First connector strap slot 56 has a longitudinal axis that perpendicular to the plane of curvature of the hook-shaped member on first connector hook 52. First connector strap slot 56 slot functions as an adjustable attachment point between the first end of horizontal strap 40 and the first connector 50. Any known means of reversible adjustable attachment may be used. In best mode, the first end of horizontal strap 40 has a horizontal strap hook and loop attachment area 42 to provide a means of reversible adjustable attachment to first connector strap slot 56 wherein the first end of horizontal strap 40 is threaded through first connector strap slot 56 and then looped back and attached to itself with the horizontal strap hook and loop attachment area 42 to complete the reversible adjustable attachment. To install horizontal strap 40, the first end of horizontal strap 40 is fed through the first slot 15, then fed through the strap tunnel 14, then fed through the third slot 17, and then adjustably attached to first connector strap slot 56.

Second connector 60 is a rigid U-shaped clip, catch, clasp, fastener, or hook. Second connector 60 has a second connector hook 62 which is a rigid hook-shaped member that hooks onto the right ear hole 106 of a baseball or softball helmet 100 for a right-handed batter configuration or alternately hooks onto the left ear hole 104 of a baseball or softball helmet 100 for a left-handed batter configuration. In best mode, second connector hook 62 is a rigid hook-shaped member with an ear member or flange member at the end of the hook. Ear member or flange member is a rigid tab that projects outward in the opposite direction of the curvature on the hook-shaped member as depicted. Ear member or flange member functions to help guide the hook-shaped member into the right or left ear hole 104,106 of the baseball or softball helmet 100. This rigid tab member allows the second connector hook 62 to more easily slide into right or left ear hole 104,106 and then firmly hook itself onto the right or left ear hole 104,106. First connector 50 is identical to second connector 60.

Second connector 60 further comprises: a second connector elongated base 64 and a second connector strap slot 66. Second connector elongated base 64 is a rigid rectangular planar member with a first end and a second end. The first end of second connector elongated base 64 is rigidly attached to second connector hook 62. The second end of second connector elongated base 64 is rigidly attached to second connector strap slot 66. Second connector elongated base 64 functions to provide distance between second connector hook 62 and the second connector strap slot 66. This distance provides more leverage on second connector hook 62 and allows for a more rigid and sturdy attachment between second connector hook 62 and ear holes 104,106. Second connector elongated base 64 allows horizontal strap 40 to pull second connector 60 more firmly against the baseball helmet or softball helmet 100.

Second connector strap slot 66 is an aperture, slit, slot, or elongated opening in second connector elongated base 64. Second connector strap slot 66 has a longitudinal axis that perpendicular to the plane of curvature of the hook-shaped member on second connector hook 62. Second connector strap slot 66 slot functions as a permanent attachment point between the second end of horizontal strap 40 and the second connector 60 wherein the second end of horizontal strap 40 is threaded through second connector strap slot 66, looped around, and attached to itself to form a permanent loop to permanently attach the second connector 60 to the second end of horizontal strap 40. In best mode permanent attachment is done by sewing as depicted.

Pole or rigid oblong member 80 is a post, pillar, stanchion, bar, shaft, pole or rigid oblong member. Pole or rigid oblong member 80 has a first end, a second end, a length, an outer diameter, an outer surface, and a longitudinal axis. The first end of pole or rigid oblong member 80 is rigidly attached to socket 13. The outer diameter of the first end of pole or rigid oblong member 80 is sized to make a friction fit with the inner diameter of socket 13. Socket 13 functions to engage with and receive the first end of pole of rigid oblong member 80 wherein the first end of pole or rigid oblong member 80 is inserted into socket 13 where it is retained by friction forces between the outer surface of pole or rigid oblong member 80 and the inner diameter surface of socket 13. The friction forces that hold pole or rigid oblong member into place within socket 13 are within a range so that the pole or rigid oblong member 80 may be removed from socket 13 by simply pulling the pole or rigid oblong member out of the socket 13 by hand. When pole or rigid oblong member 80 is attached within socket 13, the longitudinal axis of pole or rigid oblong member 80 is perpendicular to the plane or horizontal axis of pedestal 11. Optionally and in best mode, the first end of pole or rigid oblong member 80 is permanently attached within socket 13 using glue, epoxy, weld, or sonic welding.

Optionally, pole or rigid oblong member 80 may be telescopic or made of concentric segments that slide together. In this embodiment, pole or rigid oblong member 80 comprises: a first segment 81, a second segment 82, and a third segment 83. Each segment has a first end, a second end, an outer diameter, an outer surface, an inner diameter, an inner surface, and a longitudinal axis. The first end of first segment 81 is rigidly attachable to the second end of socket 13. The outer diameter of the first end of the first segment 81 is sized to make a friction fit with the inner diameter of socket 13. Socket 13 functions to engage with and receive the first end of the first segment 81 wherein the first end of the first segment 81 is inserted into socket 13 where it is retained by friction forces between the outer surface of the first end of the first segment 81 and the inner diameter surface of socket 13. The friction forces that hold the first segment 81 into place within socket 13 are within a range so that the first segment 81 may be removed from socket 13 by simply pulling the first segment 81 out of the socket 13 by hand. When first segment 81 is attached within socket, the longitudinal axis of first segment is perpendicular to the plane or horizontal axis of pedestal 11. Optionally and in best mode, the first end of the first segment 81 is permanently attached to socket 13 using glue, epoxy, or weld. First segment 81, second segment 82, and third segment 83 are telescopic, meaning that the third segment 83 slides within the second segment 82 which slides within the first segment 81. The inner diameter of the first segment 81 is sized to make a friction fit or slip fit with the outer diameter of the second segment 82. The inner diameter of the second segment 82 is sized to make a friction fit or slip fit with the outer diameter of the third segment 83. With this design, the pole or rigid oblong member 80 may be extended and retracted like an old-time radio antenna. A telescopic pole of rigid oblong member 80 makes storage and use of the swing guide device 5 easier.

Optionally, pole or rigid oblong member 80 have an electronic tip 86. Electronic tip 86 is a post, pillar, stanchion, bar, shaft, pole or rigid oblong member with an integrated circuit board, electronic chip, or computer and a battery inside. The battery is electrically connected to integrated circuit board, electronic chip, or computer. Electronic tip 86 has a first end, a second end, a length, an outer diameter, an outer surface, and a longitudinal axis. The first end of electronic tip 86 is reversibly rigidly attachable the second end of pole or rigid oblong member 80 or the second end of the third segment 83. Integrated circuit board, electronic chip, or computer is capable of communicating over a network or computer network such as WIFI, Bluetooth, Cellular, or any other known network protocol. Electronic tip 86 may further comprise one or more sensors on its outer surface that are electrically connected to battery. Each of the one or more sensors would detect the exact time that a bat 110 passes by the sensor or contacted the sensor and transmit this data back to the integrated circuit board, electronic chip, or computer. Software loaded onto the integrated circuit board, electronic chip, or computer can determine information such as bat 110 speed and the exact time that the bat 110 leaves contact with the pole or rigid oblong member 80. Integrated circuit board, electronic chip, or computer may further comprise a speaker that emits sounds so that an audible alert may heard by the swinger when the bat 110 leaves contact with the pole or rigid oblong member.

Optionally, swing guide device 5 may further comprise two strap clasps 70. Each strap clasp 70 is a clip or clasp that holds down or retains the loose ends vertical strap 20 and horizontal strap 40 to prevent them from flapping around in the air. One strap clasp holds down the first end of vertical strap 20. The second strap clasp 70 holds down the first end of horizontal strap 40. Each strap clasp 70 comprises: a strap clasp first lower wing 72; a strap clasp second lower wing 74; and a strap clasp upper wing 76. Strap clasp first lower wing 72 and strap clasp second lower wing 74 for a slot through which vertical strap 20 or horizontal strap 40 is disposed within as depicted. Strap clasp upper wing 76 forms a slot through which the first end of vertical strap 20 or horizontal strap 40 is disposed within as depicted. To install a strap clasp 70 onto vertical strap 20, strap clasp 70 is attached to vertical strap 20 in between the upper connector 30 and the pedestal 11 by inserting vertical strap 20 into the slot created by strap clasp first lower wing 72 and strap clasp second lower wing 74 as depicted. Next, the first end of vertical strap 20 is pulled tight to apply tension between upper connector 30 and the pedestal 11. Then the first end of vertical strap 20 is looped back and attached to vertical strap 20 as discussed above in order to capture this tension on the vertical strap 20. Finally, the first end of vertical strap 20, which is loose, is attached to and tucked into the strap clasp upper wing 76 in order to retain the first end of vertical strap 20 as depicted. To install a strap clasp 70 onto horizontal strap 40, strap clasp 70 is attached to horizontal strap 40 in between first connector 50 and the pedestal 11 by inserting horizontal strap 40 into the slot created by strap clasp first lower wing 72 and strap clasp second lower wing 74 as depicted. Next, the first end of horizontal strap 40 is pulled tight to apply tension between first connector 50 and the pedestal 11. Then the first end of horizontal strap 40 is looped back and attached to horizontal strap 40 as discussed above in order to capture this tension on the horizontal strap 40. Finally, the first end of horizontal strap 40, which is loose, is attached to and tucked into the strap clasp upper wing 76 in order to retain the first end of horizontal strap 40 as depicted.

Optionally, swing guide device 5 may further comprise an adjustable hinge member 90. Adjustable hinge member 90 is an adjustable hinge that may be adjusted by hand to any angle between 0 and 180 degrees and then set at that particular angle to rigidly hold at that angle. Adjustable hinge member 90 has a first end, a second end, a hinge joint 92, and a set screw 94. The first end of adjustable hinge member 90 is a rigid cylindrical member with an outside diameter that is sized to make a fiction fit with the inside diameter of socket 13. The first end of adjustable hinge member 90 is rigidly attachable to the second end of socket 13. Optionally and in best mode, the first end of adjustable hinge member 90 is permanently attached to socket 13 using glue, epoxy, or weld. The second end of adjustable hinge member 90 is a rigid cylindrical member that is rigidly attachable to the first end of pole or rigid oblong member 80 or the first end of the first segment 81. Rigid attachment may be accomplished by any known means such as glue, epoxy, or weld. In best mode, the second end of adjustable hinge member 90 is integral with the first end of rigid oblong member 80 or the first end of the first segment 81 and constructed from the same piece of material.

Hinge joint 92 is a movable joint, mechanism, or bearing wherein a first end rotates or swings out and back from a second end and may be set and held at any particular angle or point of the swing. The second end of hinge joint 92 may be set at any angle from 0-180 degrees inclusive relative to the first end of hinge joint 92. Set screw 94 is a screw, bolt, or oblong threaded member that engages with the hinge joint 92 to clamp down onto hinge joint 92 or clamp down on wings that in turn clamp down onto hinge joint 92. After the set screw 94 is loosened, the hinge joint 92 may be adjusted to or set at any desired angle, then the set screw 93 is tightened to clamp down on hinge joint 92 or wings to firmly hold the hinge joint 92 at that particular angle. The first end of hinge joint 92 is the first end of adjustable hinge member 90 and the second end of hinge joint 92 is the second end of adjustable hinge member 90. Adjustable hinge member 90 allows the pole or rigid oblong member 80 to be adjusted relative to the attached base member 10 in order to make the final adjustment of positioning of the pole or rigid oblong member 80 in order to keep that bat 110 aligned with the swing plane of the baseball or softball 112 trajectory. In best mode, hinge joint 92 is a ball joint with a set screw 94 that loosens and tightens on the ball joint. Any known type of ball joint may be used.

In order to use swing guide device 5, swing guide device 5 is reversibly rigidly attached to a baseball helmet or softball helmet 100. This is accomplished by first determining whether the user is right-handed or left-handed. If the user is right-handed, vertical strap 20 must be inserted through and attached to second slot 16 of base member 10. A large capital "R" is adjacent to second slot 16, as depicted, in order to readily show the user which slot is second slot 16 for right-handed batters. There is no need to adjust horizontal strap 40 because horizontal strap 40 remains in the same slots for left and right handed users. If the user is left-handed, vertical strap 20 must be inserted through and attached to fourth slot 18 of base member 10. A large capital "L" is adjacent to fourth slot 18, as depicted, in order to readily show the user which slot is fourth slot 18 for left-handed batters. There is no need to adjust horizontal strap 40 because horizontal strap 40 remains in the same slots for left and right handed users. Next, the upper connector 30 is reversibly attached or hooked to an upper vent hole 102 of a baseball or softball helmet 100. Next, the first connector 50 is reversibly attached or hooked to the left ear hole 104 of the baseball or softball helmet 100. Next, the second connector 60 is reversibly attached or hooked to the right ear hole 106 of the baseball or softball helmet 100. Next, the pole or rigid oblong member 80 is attached within the socket 13. However, in best mode, swing guide device 5 is shipped to the user with pole or rigid oblong member 80 is already permanently attached within the socket 13. Then the base member 10 is moved and positioned at the exact correct spot on the outer surface of the baseball or softball helmet 100 so that the pole or rigid oblong member 80 provides proper guidance or a track to put the bat 110 in the swing plane of the baseball or softball 112 trajectory. Next, the vertical strap 20 is tightened to apply tension between the base member 10 and an upper vent hole 102 of the baseball or softball helmet 100. The vertical strap 20 is tightened by detaching the first end of vertical strap 20 and then pulling the vertical strap 20 tight and then reattaching the first end of the vertical strap 20 into the secure position. Next the horizontal strap 40 is tightened to create tension on the horizontal strap 40 which firmly holds the base member 10 against the outer surface of the baseball or softball helmet 100. The horizontal strap 40 is tightened by detaching the first end of horizontal strap 40 and then pulling the horizontal strap 40 tight and then reattaching the first end of the horizontal strap 40 into the secure position. With the vertical and horizontal straps 20,40 pulled tight and attached, the swing guide device 5 is sturdily and rigidly attached to the baseball or softball helmet 100. Now the swing guide device 5 may be used to guide and keep the bat 110 in the proper swing plane. In may take some time and repeated adjustment of the base member 10 in order to find the exact proper positioning of the base member 10 on the helmet 100 to yield proper swing plane guidance of the swing guide device 5. The base member 10 is adjusted by first loosening the horizontal and vertical straps 20,40 and then moving the base member 10 into the desired location and then re-tightening the horizontal and vertical straps 20,40.

What is claimed is:

1. A swing guide device comprising: a base member; a vertical strap; a horizontal strap; an upper connector; a first connector; a second connector; and a pole or rigid oblong member, wherein, said base member comprises: a pedestal; a pedestal pad; a socket; a strap tunnel; a first slot; a second slot; a third slot; and a fourth slot, wherein, said pedestal is a rigid planar member with a length, a width, a thickness, a first edge, a second edge, a third edge, a fourth edge, an outer surface, an inner service, a horizontal axis, and a vertical axis, said pedestal pad is a resilient planar member with an outer surface and an inner surface, said outer surface of pedestal pad is rigidly attached to said inner surface of said pedestal, said socket is a rigid hollow cylindrical member with an inner diameter, an outer diameter, an inner surface, an outer surface, a length, a side, a first end, a second end, and a longitudinal axis, said first end of said socket is closed, said second end of said socket is open, said first end of said socket is rigidly attached to said outer surface of said pedestal so that said longitudinal axis of said socket is perpendicular to said horizontal axis of said pedestal, said strap tunnel is a clearance passage, shaft, or tunnel in between said first end of said socket and said outer surface of said pedestal, wherein said socket is rigidly attached to said outer surface of said pedestal so said socket is raised above or held above said outer surface of said pedestal to yield clearance for said horizontal strap to pass between said first end of said socket and said outer surface of pedestal, said first slot is an aperture, slit, slot, or elongated opening in said pedestal with a width, length, an outer surface, an inner surface, and longitudinal axis, said first slot is located adjacent to said first edge of said pedestal with said longitudinal axis of said first slot parallel with said first edge of said pedestal, said second slot is an aperture, slit, slot, or elongated opening in said pedestal with a width, length, an outer surface, an inner surface, and longitudinal axis, said second slot is located adjacent to said second edge of said pedestal with said longitudinal axis of said second slot parallel with said second edge of said pedestal, said third slot is an aperture, slit, slot, or elongated opening in said pedestal with a width, length, an outer surface, an inner surface, and longitudinal axis, said third slot is located adjacent to said third edge of said pedestal with said longitudinal axis of said third slot parallel with said third edge of said pedestal, said fourth slot is an aperture, slit, slot, or elongated opening in said pedestal with a width, length, an outer surface, an inner surface, and longitudinal axis, said fourth slot is located adjacent to said fourth edge of said pedestal with said longitudinal axis of said fourth slot parallel with said fourth edge of said pedestal, said vertical strap is a flexible band, belt, strap, or tape member with a first end, a second end, a length, a width, a thickness, a longitudinal axis, and a latitudinal axis, said upper connector is a rigid U-shaped clip, catch, clasp, fastener, or hook with an upper connector hook that is a rigid hook-shaped and an upper connector strap slot that is an aperture, slit, slot, or elongated opening that is rigidly attached to upper connector hook, said second end of said vertical strap is attached to said upper connector strap slot on said upper connector, said first end of said vertical strap is attached to said second slot on said pedestal or alternately attached to said fourth slot on said pedestal, said horizontal strap is a flexible band, belt, strap, or tape member with a first end, a second end, a length, a width, a thickness, a longitudinal axis, and a latitudinal axis, said first connector is a rigid U-shaped clip, catch, clasp, fastener, or hook with: a first connector hook that is a rigid hook-shaped member; a first connector elongated base that is a rigid rectangular planar member rigidly attached to said first connector hook; and a first connector strap slot that is an aperture, slit, slot, or elongated opening rigidly attached to said first connector elongated base, said second connector is a rigid U-shaped clip, catch, clasp, fastener, or hook with: a second connector hook that is a rigid hook-shaped member; a second connector elongated base that is a rigid rectangular planar member rigidly attached to said second connector hook; and a second connector strap slot that is an aperture, slit, slot, or elongated opening rigidly attached to said second connector elongated base, said first end of said horizontal strap is attached to said first connector strap slot, said second end of said horizontal strap is attached to said second connector strap slot, said pole or rigid oblong member is a post, pillar, stanchion, bar, shaft, pole or rigid oblong member with a first end, a second end, a length, an outer diameter, an outer surface, and a longitudinal axis, and said first end of said pole or rigid oblong member is rigidly attached to said second end of said socket and within said socket so that said longitudinal axis of said pole or rigid oblong member is perpendicular to said horizontal axis of said pedestal.

2. A swing guide device comprising: a base member; a vertical strap; a horizontal strap; an upper connector; a first connector; a second connector; and a pole or rigid oblong member, wherein, said base member comprises: a pedestal; a pedestal pad; a socket; a strap tunnel; a first slot; a second slot; a third slot; and a fourth slot, wherein, said pedestal is a rigid planar member with a length, a width, a thickness, a first edge, a second edge, a third edge, a fourth edge, an outer surface, an inner service, a horizontal axis, and a vertical axis, said pedestal pad is a resilient planar member with an outer surface and an inner surface, said outer surface of pedestal pad is rigidly attached to said inner surface of said pedestal, said socket is a rigid hollow cylindrical member with an inner diameter, an outer diameter, an inner surface, an outer surface, a length, a side, a first end, a second end, and a longitudinal axis, said first end of said socket is closed, said second end of said socket is open, said first end of said socket is rigidly attached to said outer surface of said pedestal so that said longitudinal axis of said socket is perpendicular to said horizontal axis of said pedestal, said strap tunnel is a clearance passage, shaft, or tunnel in between said first end of said socket and said outer surface of said pedestal, wherein said socket is rigidly attached to said outer surface of said pedestal so said socket is raised above or held above said outer surface of said pedestal to yield clearance for said horizontal strap to pass between said first end of said socket and said outer surface of pedestal, said first slot is an aperture, slit, slot, or elongated opening in said pedestal with a width, length, an outer surface, an inner surface, and longitudinal axis, said first slot is located adjacent to said first edge of said pedestal with said longitudinal axis of said first slot parallel with said first edge of said pedestal, said second slot is an aperture, slit, slot, or elongated opening in said pedestal with a width, length, an outer surface, an inner surface, and longitudinal axis, said second slot is located adjacent to said second edge of said pedestal with said longitudinal axis of said second slot parallel with said second edge of said pedestal, said third slot is an aperture, slit, slot, or elongated opening in said pedestal with a width, length, an outer surface, an inner surface, and longitudinal axis, said third slot is located adjacent to said third edge of said pedestal with said longitudinal axis of said third slot parallel with said third edge of said pedestal, said fourth slot is an aperture, slit, slot, or elongated opening in said pedestal with a width, length, an outer surface, an inner surface, and longitudinal axis, said fourth slot is located adjacent to said fourth edge of said pedestal with said longitudinal axis of said fourth slot parallel with said fourth edge of said pedestal, said vertical strap is a flexible band, belt, strap, or tape member with a first end, a second end, a length, a width, a thickness, a longitudinal axis, and a latitudinal axis, said upper connector is a rigid U-shaped clip, catch, clasp, fastener, or hook with an upper connector hook that is a rigid hook-shaped and an upper connector strap slot that is an aperture, slit, slot, or elongated opening that is rigidly attached to upper connector hook, said second end of said vertical strap is attached to said upper connector strap slot on said upper connector, said first end of said vertical strap is attached to said second slot on said pedestal or alternately attached to said fourth slot on said pedestal, said horizontal strap is a flexible band, belt, strap, or tape member with a first end, a second end, a length, a width, a thickness, a longitudinal axis, and a latitudinal axis, said first connector is a rigid U-shaped clip, catch, clasp, fastener, or hook with: a first connector hook that is a rigid hook-shaped member; a first connector elongated base that is a rigid rectangular planar member rigidly attached to said first connector hook; and a first connector strap slot that is an aperture, slit, slot, or elongated opening rigidly attached to said first connector elongated base, said second connector is a rigid U-shaped clip, catch, clasp, fastener, or hook with: a second connector hook that is a rigid hook-shaped member; a second connector elongated base that is a rigid rectangular planar member rigidly attached to said second connector hook; and a second connector strap slot that is an aperture, slit, slot, or elongated opening rigidly attached to said second connector elongated base, said first end of said horizontal strap is attached to said first connector strap slot, said second end of said horizontal strap is attached to said second connector strap slot, said pole or rigid oblong member is a telescopic post, pillar, stanchion, bar, shaft, pole or rigid oblong member with a first segment, a second segment, and a third segment, wherein, said first segment has a first end, a second end, an outer diameter, an outer surface, an inner diameter, an inner surface, and a longitudinal axis, said second segment has a first end, a second end, an outer diameter, an outer surface, an inner diameter, an inner surface, and a longitudinal axis, said third segment has a first end, a second end, an outer diameter, an outer surface, an inner diameter, an inner surface, and a longitudinal axis, said first segment, said second segment, and said third segment are telescopic, meaning that said third segment slides within said second segment which slides within said first segment, wherein, said inner diameter of said first segment is sized to make a friction fit or slip fit with said outer diameter of said second segment and said inner diameter of said second segment is sized to make a friction fit or slip fit with said outer diameter of said third segment, and said first end of said first segment is rigidly attached to said second end of said socket so that said longitudinal axis of said first segment is perpendicular to said horizontal axis of said pedestal.

3. A swing guide device comprising: a base member; a vertical strap; a horizontal strap; an upper connector; a first connector; a second connector; an adjustable hinge member; and a pole or rigid oblong member, wherein, said base member comprises: a pedestal; a pedestal pad; a socket; a strap tunnel; a first slot; a second slot; a third slot; and a fourth slot, wherein, said pedestal is a rigid planar member with a length, a width, a thickness, a first edge, a second edge, a third edge, a fourth edge, an outer surface, an inner service, a horizontal axis, and a vertical axis, said pedestal pad is a resilient planar member with an outer surface and an inner surface, said outer surface of pedestal pad is rigidly attached to said inner surface of said pedestal, said socket is a rigid hollow cylindrical member with an inner diameter, an outer diameter, an inner surface, an outer surface, a length, a side, a first end, a second end, and a longitudinal axis, said first end of said socket is closed, said second end of said socket is open, said first end of said socket is rigidly attached to said outer surface of said pedestal so that said longitudinal axis of said socket is perpendicular to said horizontal axis of said pedestal, said strap tunnel is a clearance passage, shaft, or tunnel in between said first end of said socket and said outer surface of said pedestal, wherein said socket is rigidly attached to said outer surface of said pedestal so said socket is raised above or held above said outer surface of said pedestal to yield clearance for said horizontal strap to pass between said first end of said socket and said outer surface of pedestal, said first slot is an aperture, slit, slot, or elongated opening in said pedestal with a width, length, an outer surface, an inner surface, and longitudinal axis, said first slot is located adjacent to said first edge of said pedestal with said longitudinal axis of said first slot parallel with said first edge of said pedestal, said second slot is an aperture, slit, slot, or elongated opening in said pedestal with a width, length, an outer surface, an inner surface, and longitudinal axis, said second slot is located adjacent to said second edge of said pedestal with said longitudinal axis of said second slot parallel with said second edge of said pedestal, said third slot is an aperture, slit, slot, or elongated opening in said pedestal with a width, length, an outer surface, an inner surface, and longitudinal axis, said third slot is located adjacent to said third edge of said pedestal with said longitudinal axis of said third slot parallel with said third edge of said pedestal, said fourth slot is an aperture, slit, slot, or elongated opening in said pedestal with a width, length, an outer surface, an inner surface, and longitudinal axis, said fourth slot is located adjacent to said fourth edge of said pedestal with said longitudinal axis of said fourth slot parallel with said fourth edge of said pedestal, said vertical strap is a flexible band, belt, strap, or tape member with a first end, a second end, a length, a width, a thickness, a longitudinal axis, and a latitudinal axis, said upper connector is a rigid U-shaped clip, catch, clasp, fastener, or hook with an upper connector hook that is a rigid hook-shaped and an upper connector strap slot that is an aperture, slit, slot, or elongated opening that is rigidly attached to upper connector hook, said second end of said vertical strap is attached to said upper connector strap slot on said upper connector, said first end of said vertical strap is attached to said second slot on said pedestal or alternately attached to said fourth slot on said pedestal, said horizontal strap is a flexible band, belt, strap, or tape member with a first end, a second end, a length, a width, a thickness, a longitudinal axis, and a latitudinal axis, said first connector is a rigid U-shaped clip, catch, clasp, fastener, or hook with: a first connector hook that is a rigid hook-shaped member; a first connector elongated base that is a rigid rectangular planar member rigidly attached to said first connector hook; and a first connector strap slot that is an aperture, slit, slot, or elongated opening rigidly attached to said first connector elongated base, said second connector is a rigid U-shaped clip, catch, clasp, fastener, or hook with: a second connector hook that is a rigid hook-shaped member; a second connector elongated base that is a rigid rectangular planar member rigidly attached to said second connector hook; and a second connector strap slot that is an aperture, slit, slot, or elongated opening rigidly attached to said second connector elongated base, said first end of said horizontal strap is attached to said first connector strap slot, said second end of said horizontal strap is attached to said second connector strap slot, said adjustable hinge member is an adjustable hinge that may be adjusted to a particular angle and then set at said particular angle to rigidly hold at said particular angle, said adjustable hinge member has a first end, a second end, a hinge joint, and a set screw, said hinge joint is a movable joint, mechanism, or bearing with a first end and a second end, said set screw is a screw, bolt, or oblong threaded member that engages with said hinge joint to clamp down onto said hinge joint and hold said hinge joint in a particular position or angle, said pole or rigid oblong member is a post, pillar, stanchion, bar, shaft, pole or rigid oblong member with a first end, a second end, a length, an outer diameter, an outer surface, and a longitudinal axis, said first end of said adjustable hinge member is a rigid cylindrical member that is rigidly attached to said second end of said socket, and said second end of said adjustable hinge member is a rigid cylindrical member that is rigidly attached to said first end of said pole or rigid oblong member.

4. A swing guide device comprising: a base member; a vertical strap; a horizontal strap; an upper connector; a first connector; a second connector; an adjustable hinge member; and a pole or rigid oblong member, wherein, said base member comprises: a pedestal; a pedestal pad; a socket; a strap tunnel; a first slot; a second slot; a third slot; and a fourth slot, wherein, said pedestal is a rigid planar member with a length, a width, a thickness, a first edge, a second edge, a third edge, a fourth edge, an outer surface, an inner service, a horizontal axis, and a vertical axis, said pedestal pad is a resilient planar member with an outer surface and an inner surface, said outer surface of pedestal pad is rigidly attached to said inner surface of said pedestal, said socket is a rigid hollow cylindrical member with an inner diameter, an outer diameter, an inner surface, an outer surface, a length, a side, a first end, a second end, and a longitudinal axis, said first end of said socket is closed, said second end of said socket is open, said first end of said socket is rigidly attached to said outer surface of said pedestal so that said longitudinal axis of said socket is perpendicular to said horizontal axis of said pedestal, said strap tunnel is a clearance passage, shaft, or tunnel in between said first end of said socket and said outer surface of said pedestal, wherein said socket is rigidly attached to said outer surface of said pedestal so said socket is raised above or held above said outer surface of said pedestal to yield clearance for said horizontal strap to pass between said first end of said socket and said outer surface of pedestal, said first slot is an aperture, slit, slot, or elongated opening in said pedestal with a width, length, an outer surface, an inner surface, and longitudinal axis, said first slot is located adjacent to said first edge of said pedestal with said longitudinal axis of said first slot parallel with said first edge of said pedestal, said second slot is an aperture, slit, slot, or elongated opening in said pedestal with a width, length, an outer surface, an inner surface, and longitudinal axis, said second slot is located adjacent to said second edge of said pedestal with said longitudinal axis of said second slot parallel with said second edge of said pedestal, said third slot is an aperture, slit, slot, or elongated opening in said pedestal with a width, length, an outer surface, an inner surface, and longitudinal axis, said third slot is located adjacent to said third edge of said pedestal with said longitudinal axis of said third slot parallel with said third edge of said pedestal, said fourth slot is an aperture, slit, slot, or elongated opening in said pedestal with a width, length, an outer surface, an inner surface, and longitudinal axis, said fourth slot is located adjacent to said fourth edge of said pedestal with said longitudinal axis of said fourth slot parallel with said fourth edge of said pedestal, said vertical strap is a flexible band, belt, strap, or tape member with a first end, a second end, a length, a width, a thickness, a longitudinal axis, and a latitudinal axis, said upper connector is a rigid U-shaped clip, catch, clasp, fastener, or hook with an upper connector hook that is a rigid hook-shaped and an upper connector strap slot that is an aperture, slit, slot, or elongated opening that is rigidly attached to upper connector hook, said second end of said vertical strap is attached to said upper connector strap slot on said upper connector, said first end of said vertical strap is attached to said second slot on said pedestal or alternately attached to said fourth slot on said pedestal, said horizontal strap is a flexible band, belt, strap, or tape member with a first end, a second end, a length, a width, a thickness, a longitudinal axis, and a latitudinal axis, said first connector is a rigid U-shaped clip, catch, clasp, fastener, or hook with: a first connector hook that is a rigid hook-shaped member; a first connector elongated base that is a rigid rectangular planar member rigidly attached to said first connector hook; and a first connector strap slot that is an aperture, slit, slot, or elongated opening rigidly attached to said first connector elongated base, said second connector is a rigid U-shaped clip, catch, clasp, fastener, or hook with: a second connector hook that is a rigid hook-shaped member; a second connector elongated base that is a rigid rectangular planar member rigidly attached to said second connector hook; and a second connector strap slot that is an aperture, slit, slot, or elongated opening rigidly attached to said second connector elongated base, said first end of said horizontal strap is attached to said first connector strap slot, said second end of said horizontal strap is attached to said second connector strap slot, said adjustable hinge member is an adjustable hinge that may be adjusted to a particular angle and then set at said particular angle to rigidly hold at said particular angle, said adjustable hinge member has a first end, a second end, a hinge joint, and a set screw, said hinge joint is a movable joint, mechanism, or bearing with a first end and a second end, said set screw is a screw, bolt, or oblong threaded member that engages with said hinge joint to clamp down onto said hinge joint and hold said hinge joint in a particular position or angle, said pole or rigid oblong member is a telescopic post, pillar, stanchion, bar, shaft, pole or rigid oblong member with a first segment, a second segment, and a third segment, wherein, said first segment has a first end, a second end, an outer diameter, an outer surface, an inner diameter, an inner surface, and a longitudinal axis, said second segment has a first end, a second end, an outer diameter, an outer surface, an inner diameter, an inner surface, and a longitudinal axis, said third segment has a first end, a second end, an outer diameter, an outer surface, an inner diameter, an inner surface, and a longitudinal axis, said first segment, said second segment, and said third segment are telescopic, meaning that said third segment slides within said second segment which slides within said first segment, wherein, said inner diameter of said first segment is sized to make a friction fit or slip fit with said outer diameter of said second segment and said inner diameter of said second segment is sized to make a friction fit or slip fit with said outer diameter of said third segment, and said first end of said first segment is rigidly attached to said second end of said socket so that said longitudinal axis of said first segment is perpendicular to said horizontal axis of said pedestal.

* * * * *